US008107848B2

(12) United States Patent
Nozawa et al.

(10) Patent No.: US 8,107,848 B2
(45) Date of Patent: Jan. 31, 2012

(54) IMAGE FORMING APPARATUS WITH CONTACT/SEPARATION MECHANISM TO/FROM INTERMEDIATE TRANSFER BODY

(75) Inventors: Shigeki Nozawa, Hoi-gun (JP); Toshiya Furubayashi, Toyokawa (JP); Yoshinori Maruyama, Toyokawa (JP); Takashi Honda, Toyokawa (JP); Masao Kondo, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 520 days.

(21) Appl. No.: 12/341,554

(22) Filed: Dec. 22, 2008

(65) Prior Publication Data

US 2009/0232539 A1 Sep. 17, 2009

(30) Foreign Application Priority Data

Mar. 17, 2008 (JP) ..... 2008-068157

(51) Int. Cl.
*G03G 15/16* (2006.01)

(52) U.S. Cl. ..... 399/101; 399/302

(58) Field of Classification Search ..... 399/49, 399/101, 302, 308

See application file for complete search history.

(56) References Cited

U.S. PATENT DOCUMENTS

| | | | | |
|---|---|---|---|---|
| 7,190,919 | B2 * | 3/2007 | Kitagawa | 399/101 |
| 7,274,888 | B2 * | 9/2007 | Tomizawa | 399/49 |
| 2007/1021780 | | 9/2007 | Tsuboi et al. | |

FOREIGN PATENT DOCUMENTS

| | | |
|---|---|---|
| JP | 2005-300916 | 10/2005 |
| JP | 2006-133330 | 5/2006 |
| JP | 2006-337798 A | 12/2006 |
| JP | 2007-248839 | 9/2007 |
| JP | 2008-176245 | 7/2008 |
| JP | 2009-65614 | 3/2009 |

OTHER PUBLICATIONS

Japanese Notice of Grounds of Rejection mailed Mar. 16, 2010, directed towards counterpart Japanese Application No. 068157/2008; 7 pages.

* cited by examiner

*Primary Examiner* — Hoang Ngo
(74) *Attorney, Agent, or Firm* — Morrison & Foerster LLP

(57) ABSTRACT

In a printer, three toner patches are primary-transferred successively to an intermediate transfer belt. Here, after the first toner patch passes through a belt cleaner and before the second toner patch reaches the belt cleaner, and after the second toner patch passes through the belt cleaner and before the third patch reaches the belt cleaner, the belt cleaner is operated to change the state of contact to the intermediate transfer belt to a different state. A density sensor detects density of the toner image on the intermediate transfer belt, and presence/absence of the toner patch is detected. When presence/absence of the first to third patches is detected alternately, it is determined that the belt cleaner is performing the operation described above.

22 Claims, 16 Drawing Sheets

IMAGE FORMING APPARATUS WITH CONTACT/SEPARATION MECHANISM TO/FROM INTERMEDIATE TRANSFER BODY

This application is based on Japanese Patent Application No. 2008-068157 filed with the Japan Patent Office on Mar. 17, 2008, the entire content of which is hereby incorporated by reference.

BACKGROUND OF THE INVENTION

1. Field of the Invention

The present invention relates to an image forming apparatus including a contact/separation mechanism to/from an intermediate transfer body, and to a method of confirming an operation of the contact/separation mechanism in the image forming apparatus.

2. Description of the Related Art

In a four-cycle color printer as a conventional image forming apparatus performing color printing, an intermediate transfer belt as an intermediate transfer body is rotated four times to form a color image on the intermediate transfer belt. Specifically, toner images of yellow (Y), magenta (M), cyan (C) and black (K) are formed superposed on the intermediate transfer belt, and transferred to a sheet of paper, so that a color image is printed on the sheet of paper. Thereafter, in the four-cycle color printer, a cleaner (also referred to as a belt cleaner) is brought into contact with the intermediate transfer belt to scrape off toner left of the intermediate transfer belt, and then, a toner-image of yellow (Y) for the next printing is formed on the intermediate transfer belt. By the time when the intermediate transfer belt rotates and the position of the intermediate transfer belt on which the yellow (Y) toner image is formed reaches the position at which the cleaner is arranged, the cleaner is separated from the intermediate transfer belt. Thereafter, toner images of respective colors, that is, magenta (M), cyan (C) and black (K), are formed superposed on the intermediate transfer belt. For this purpose, the four-cycle color printer is provided with a mechanism for bringing the belt cleaner into contact with and separate from the intermediate transfer belt.

The mechanism for bringing the belt cleaner into contact with and separate from the intermediate transfer belt (also referred to as a cleaner contact/separation mechanism) is provided with a sensor. The sensor detects whether the belt cleaner is in contact with or separated from the intermediate transfer belt. A mechanism controlling the cleaner contact/separation mechanism controls contact/separation of the belt cleaner based on the sensor signal from the sensor. Further, based on the sensor signal, it detects abnormality of contact/separation of the belt cleaner with respect to the control, and detects any error of the cleaner contact/separation mechanism.

In a tandem type color printer as a conventional image forming apparatus performing color printing, four photoreceptors corresponding to respective colors, that is, yellow (Y), magenta (M), cyan (C) and black (K) are arranged facing to the intermediate transfer belt. In the tandem type printer, for color printing, all photoreceptors (Y, M, C, K) are brought into contact with the intermediate transfer belt and toner images of respective colors are transferred to the intermediate transfer belt. For monochrome (black) printing, photoreceptors for color printing (Y, M, C) (hereinafter referred to as color photoreceptors) are separated from the intermediate transfer belt. Only the photoreceptor for monochrome printing (K) that is in contact with the intermediate transfer belt is driven. As a result, a monochrome toner image is transferred to the intermediate transfer belt. Thus, the tandem type color printer is provided with a mechanism for bringing the color photoreceptors into contact with and separate from the intermediate transfer belt.

The mechanism for bringing the photoreceptor into contact with and separate from the intermediate transfer belt (also referred to as a photoreceptor contact/separation mechanism) is provided with a sensor. The sensor detects whether the photoreceptor is in contact with or separated from the intermediate transfer belt. A mechanism controlling the photoreceptor contact/separation mechanism controls contact/separation of the photoreceptor based on the sensor signal from the sensor. Further, based on the sensor signal, it detects abnormality of contact/separation of the photoreceptor with respect to the control, and detects any error of the photoreceptor contact/separation mechanism.

As described above, both the four-cycle color printer and the tandem type color printer include contact/separation mechanisms to/from the intermediate transfer belt. Therefore, in either of the mechanisms, a sensor for detecting the contact/separation operation has been necessary.

Cost reduction of such image forming apparatuses has been demanded. The sensor mentioned above, however, is one of the factors hindering cost reduction. By way of example, Japanese Laid-Open Patent Publication No. 2006-337798 discloses a method of determining contact/separation of belt cleaner to/from the intermediate transfer belt, by forming a toner patch on the intermediate transfer belt and detecting the toner patch using a density sensor, in a four-cycle color printer. By adopting this method, a sensor for detecting the contact/separation operation of the belt cleaner to/from the intermediate transfer belt becomes unnecessary in the four-cycle color printer. As a result, cost can be reduced.

In the method described in the afore-mentioned application, the intermediate transfer belt is rotated and after the position where the toner patch is formed passes through the position of belt cleaner, the density of toner patch is detected by the density sensor. Therefore, detection of the contact/separation operation of belt cleaner to/from the intermediate transfer belt takes time to rotate the intermediate transfer belt to have the toner-patch-formed position moved from the exposure/development position to the belt cleaner position and time to rotate from the belt cleaner position to the density sensor position. Namely, it takes time to rotate the intermediate transfer belt almost twice.

Further, at the time of power-on, for example, whether the belt cleaner is in the contact state or separate state is unknown. Therefore, in order to confirm intactness of contact/separation mechanism or to confirm that the mechanism operates normally both from the contact state to the separate state and from the separate state to the contact state, it is necessary to operate the contact/separation mechanism to form a toner patch on the intermediate transfer belt, and to operate the contact/separation mechanism in the reverse manner to form the toner patch again on the intermediate transfer belt. Specifically, it is necessary to perform twice the process for forming the toner patch and determining the state of contact/separation. This takes time to have the intermediate transfer belt rotated almost four times.

Therefore, according to the method disclosed in the aforementioned application, longer time is necessary for performing preliminary rotation and returning to the initial state and for determining any malfunction of the contact/separation mechanism thereafter. Consequently, if the state of contact/separation is confirmed to determine any malfunction of the contact/separation mechanism during printing, productivity of image forming apparatus would be decreased.

The method described in the afore-mentioned application may be applied to the tandem type color printer, and the operation of photoreceptor contact/separation mechanism may be confirmed by forming and detecting a toner patch, rather than detecting the contact/separation state of color photoreceptor by the sensor. Similar to the method applied to the four-cycle color printer, here again, longer time is necessary for performing preliminary rotation and returning to the initial state and for determining any malfunction of the contact/separation mechanism thereafter. Consequently, if the state of contact/separation is confirmed to determine any malfunction of the contact/separation mechanism during printing, productivity of image forming apparatus would be decreased.

SUMMARY OF THE INVENTION

The present invention was made in view of the foregoing and it object is to provide an image forming apparatus including a contact/separation mechanism to/from the intermediate transfer body capable of efficiently confirming operation of the contact/separation mechanism by detecting presence/absence of a patch image formed on the intermediate transfer body using a density sensor, and to provide a method of confirming operation of contact/separation mechanism in the image forming apparatus.

In order to attain the above-described object, the present invention provides an image forming apparatus, including: an image carrier carrying a toner image on its surface; a transfer unit for transferring the toner image on the image carrier to an intermediate transfer body rotating in a prescribed direction; a cleaning unit that can be brought into contact with and separated from the intermediate transfer body, for cleaning a surface of the intermediate transfer body in a contact state; a detecting unit detecting density of the toner image transferred to the intermediate transfer body; a contact/separation mechanism performing an operation of setting the cleaning unit to a state in contact with or a state separated from the intermediate transfer body; and a control unit configured to cause the transfer unit to transfer a plurality of toner images spaced by a prescribed distance in the direction of rotation on the intermediate transfer body; cause, when the plurality of toner images pass through the cleaning unit, the contact/separation mechanism to perform the operation to set the cleaning unit to the state in contact with or the state separated from the intermediate transfer body, alternately toner image by toner image; detect presence/absence of each toner image on the intermediate transfer body using the detecting unit, after the operation of the contact/separation mechanism; and determine, based on the result of detection, state of contact/separation of the cleaning unit to/from the intermediate transfer body.

According to another aspect, the present invention provides an image forming apparatus, including: a plurality of image carriers rotating in a prescribed direction; a plurality of developers supplying toner to an electrostatic latent image formed on each of the plurality of image carriers for forming toner images; a plurality of transfer units for transferring the toner images formed on the plurality of image carriers to an intermediate transfer body rotating in a prescribed direction; a detecting unit detecting density of a toner image transferred on the intermediate transfer body; a contact/separation mechanism performing an operation of setting at least one of the plurality of transfer units to a state in contact with or a state separate from the intermediate transfer body; and a control unit; wherein the control unit causes at least one of the plurality of developing units to form a plurality of toner images on at least one of the plurality of image carriers, spaced by a prescribed distance in a direction of rotation of the image carrier; when the plurality of toner images pass through the transfer unit, causes the contact/separation mechanism to perform the operation for setting the transfer unit to the state in contact with or to the state separated from the intermediate transfer body alternately toner image by toner image; after the operation of the contact/separation mechanism, detects presence/absence of each toner image on the intermediate transfer body, using the detecting unit; and determines, based on a result of the detection, state of contact/separation of the transfer unit to/from the intermediate transfer body.

According to a still further aspect, the present invention provides a method of confirming an operation of a contact/separation mechanism in an image forming apparatus including an image carrier carrying a toner image on its surface, a transfer unit for transferring the toner image on the image carrier to an intermediate transfer body rotating in a prescribed direction, a cleaning unit that can be brought into contact with and separated from the intermediate transfer body, for cleaning a surface of the intermediate transfer body in a contact state, a detecting unit detecting density of the toner image transferred to the intermediate transfer body, and the contact/separation mechanism performing an operation of setting the cleaning unit to a state in contact with or a state separated from the intermediate transfer body. The method includes the steps of: the transfer unit transferring a first toner image and a second toner image spaced by a prescribed distance in the direction of rotation on the intermediate transfer body; operating the contact/separation mechanism after transfer of the first toner image and before transfer of the second toner image, to change state of contact/separation of the cleaning unit with respect to the intermediate transfer body when the first toner image is formed different from when the second toner image is formed; and determining, if a result of detection by the detecting unit from the intermediate transfer unit after passing the position of the cleaning unit is that the first toner image and the second toner image are detected alternately from the intermediate transfer body, that the contact/separation mechanism is performing the operation.

According to yet another aspect, the present invention provides a method of confirming an operation of a contact/separation mechanism in an image forming apparatus including a plurality of image carriers rotating in a prescribed direction, a plurality of developers supplying toner to an electrostatic latent image formed on each of the plurality of image carriers for forming toner images, a plurality of transfer units for transferring the toner images formed on the plurality of image carriers to an intermediate transfer body rotating in a prescribed direction, a detecting unit detecting density of the toner image transferred on the intermediate transfer body, and the contact/separation mechanism performing an operation of setting at least one of the plurality of transfer units to a state in contact with or a state separate from the intermediate transfer body. The method includes the steps of: causing at least one of the plurality of developing units to form a plurality of toner images on at least one of the plurality of image carriers, spaced by a prescribed distance in a direction of rotation of the image carrier; causing the transfer unit to operate the contact/separation mechanism after the first toner image is passed through the transfer unit and before the second toner image is passed through the transfer unit, to change state of contact/separation of the transfer unit with respect to the intermediate transfer body when the first toner image passes through the transfer unit different from when the second toner image passes through the transfer unit; and determining, if a result of detection by the detecting unit is that the first toner image and the second toner image are detected alternately from the intermediate transfer body, that the contact/separation mechanism is performing the operation.

By the present invention, in an image forming apparatus having a contact/separation mechanism to/from an intermediate transfer body, it becomes possible to efficiently confirm the operation of contact/separation mechanism by detecting density of a toner image formed on the intermediate transfer body by the density detecting unit, without using any sensor for detecting contact/separation.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
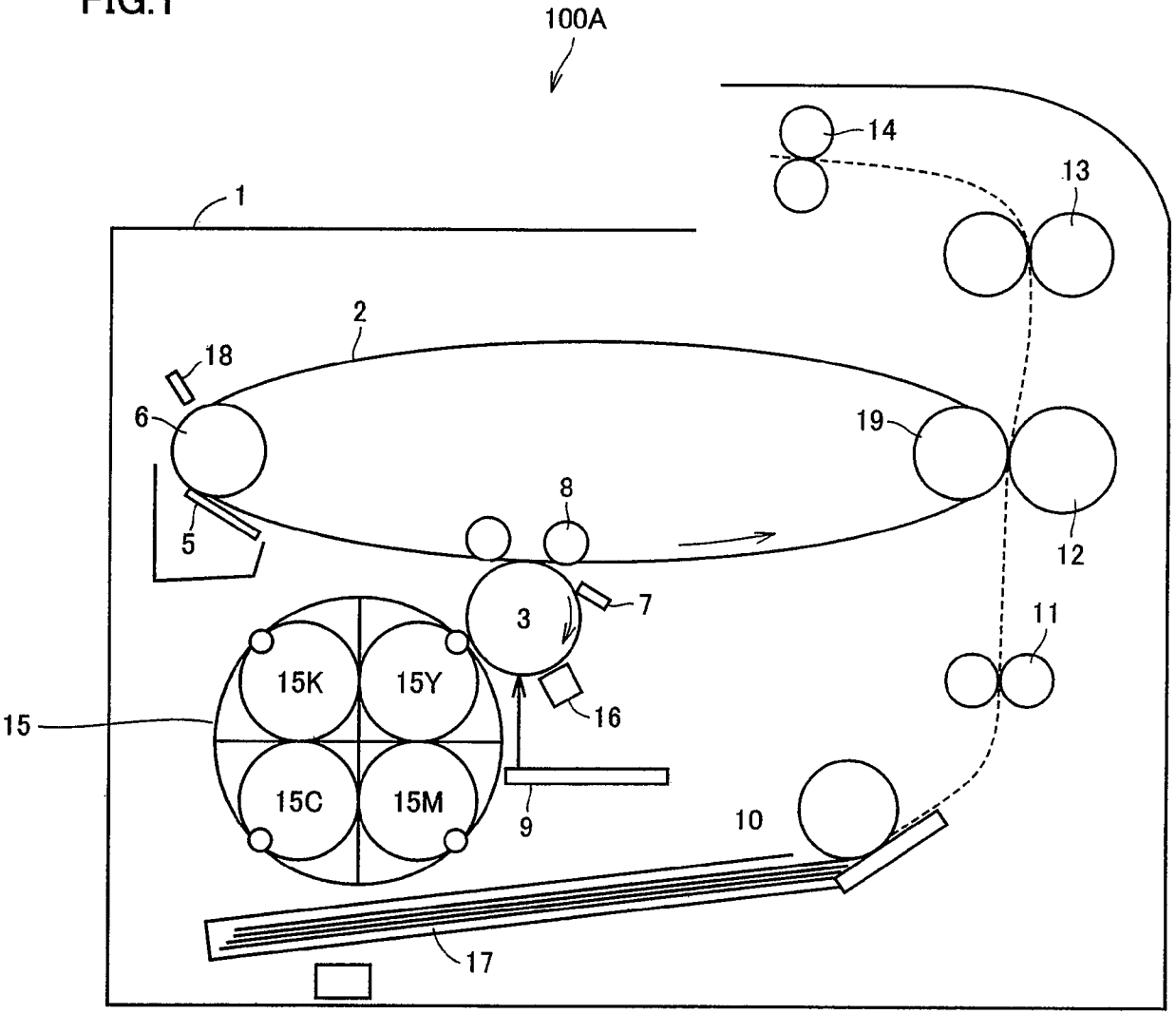
FIG. 1 schematically shows a cross-section of a four-cycle color printer in accordance with a first embodiment of the present invention.

In the following, embodiments of the present invention will be described with reference to the figures. In the following description, the same or corresponding components are denoted by the same reference characters. Their names and functions are also the same.

First Embodiment

As a first embodiment of the present invention, a four-cycle color printer as an image forming apparatus will be described.

Figure 8:
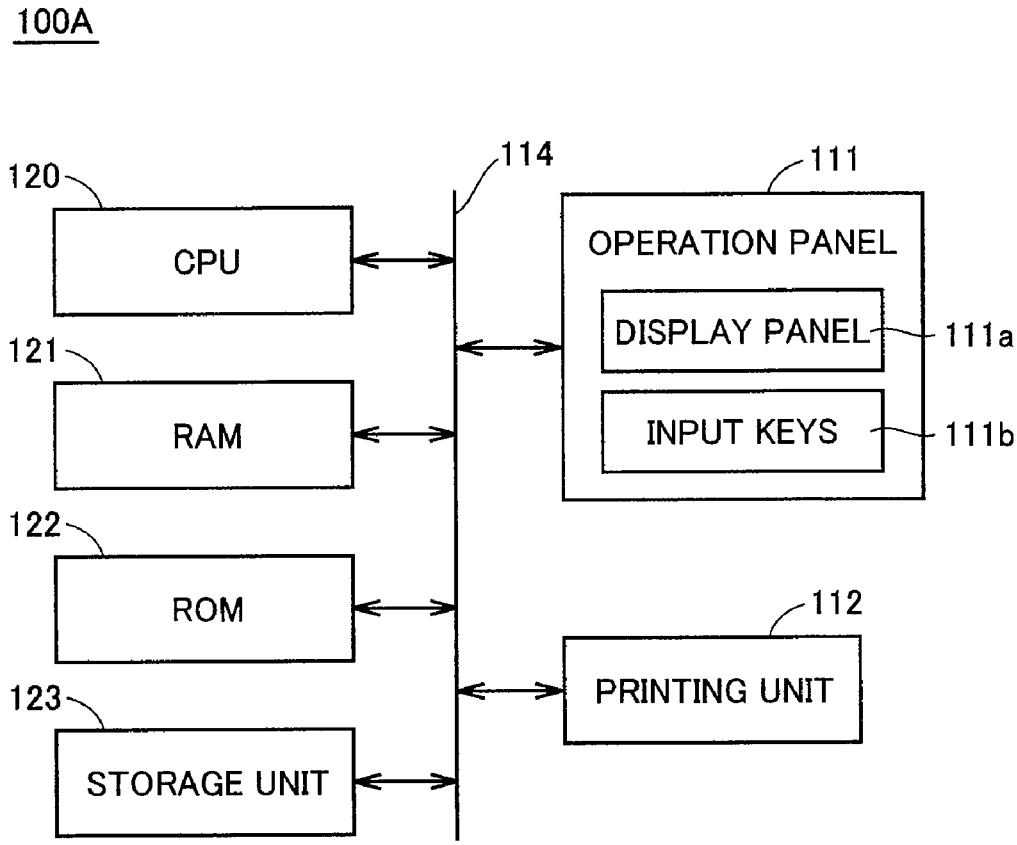
FIG. 8 is a block diagram showing a specific example of internal structure of the printer in accordance with the first embodiment of the present invention.

Referring to FIG. 1, a printer 100A in accordance with the first embodiment includes, approximately at the center therein, a photoreceptor 3 as an image carrier, coupled to a driving motor, not shown, and driven to rotate clockwise in the figure. Around the photoreceptor 3, a charger unit 16, an exposure unit 9, a developing unit 15, a primary transfer roller 8, and a cleaner 7 are arranged. The driving motor is driven in accordance with a control signal from a CPU (Central Processing Unit) 120 (FIG. 8). Therefore, rotation of photoreceptor 3 is controlled by the control signal from CPU 120.

Charging unit 16 uniformly charges the surface of photoreceptor 3. CPU 120 color-converts image signals as the object of processing to yellow (Y), magenta (M), cyan (C) and black (K), and generates digital signals. Based on the generated digital image signals, CPU 120 outputs a control signal to exposure unit 9. In accordance with the control signal from CPU 120, exposure unit 9 irradiates photoreceptor 3 with laser beams color by color, and exposes image patterns of respective colors. Consequently, color-by-color electrostatic latent images are formed on the surface of photoreceptor 3.

Developing unit 15 is formed of a rotatable development rack having cartridges 15Y, 15M, 15C and 15K (generally represented as cartridge 15) corresponding to respective colors of yellow (Y), magenta (M), cyan (C) and black (K) mounted thereon. Each cartridge 15 includes toner of the corresponding color, and a developing roller for developing the toner. The development rack is controlled by the control signal from CPU 120 such that, every time an electrostatic latent image of each color is formed on photoreceptor 3, it rotates to have the cartridge 15 corresponding to the color moves to a development position, which is close to or in contact with the photoreceptor 3. In this manner, toners of respective colors are supplied successively to photoreceptor 3, color-by-color toner images are formed on photoreceptor 3, and the electrostatic latent image is made visible.

Primary transfer roller 8 is arranged to be opposite to photoreceptor 3 with intermediate transfer belt 2 posed therebetween. When a prescribed bias voltage is applied to primary transfer roller 8 from a bias power supply, not shown, the toner adhered as a toner image on photoreceptor 3 is transferred to intermediate transfer belt 2. This transfer is referred to as primary transfer. Every time a toner image of one color is formed on photoreceptor 3, primary transfer of the image to intermediate transfer belt 2 takes place. For color printing, toner images of four colors are each primary-transferred to the intermediate transfer belt 2 and superposed one after another, forming a color toner image on intermediate transfer belt 2. Cleaner 7 has a blade that is brought into contact with the surface of photoreceptor 3, and at every primary transfer of toner image of each color on intermediate transfer belt, it scrapes off the residual toner on photoreceptor 3, before the start of toner image formation of the next color.

Intermediate transfer belt 2 as the intermediate transfer body is an endless belt, suspended over a plurality of rollers, including a primary transfer roller 8 and feed rollers 6 and 19. At least one of the plurality of rollers is a driving roller. The driving roller is coupled to a driving motor, not shown, and rotated by the driving motor. The driving motor is driven in accordance with the control signal from CPU 120. Therefore, rotation of these rollers is controlled by the control signal from CPU 120. As the driving roller rotates, intermediate transfer belt 2 is driven to rotate counter-clockwise in the figure. Consequently, timing of primary transfer is also controlled by the control signal from CPU 120.

At a lower portion of printer 100A, a recording medium container unit 17 is arranged. A sheet of paper as the recording medium, contained and stored in recording medium container unit 17 is fed by a feeding unit and discharged to a paper discharge unit 1. The feeding unit consists of a paper feed roller 10, a timing roller 11, a secondary transfer roller 12, a fixing roller 13 and a paper discharge roller 14.

Paper feed roller 10 is for feeding sheets of paper from recording medium container unit 17. Timing roller 11 is for temporarily stopping the fed recording medium.

Secondary transfer roller 12 is arranged to form a pair with feed roller 19 supporting the circular intermediate transfer belt 2 from the inside, with intermediate transfer belt posed between the pair of rollers. A prescribed bias voltage is applied from a bias power supply, not shown, to secondary transfer roller 12. A region between secondary transfer roller 12 and feed roller 19 with intermediate transfer belt 2 interposed constitutes a secondary transfer portion. Secondary transfer roller 12 is brought into contact with, or separated from, intermediate transfer belt 2 in accordance with a control signal from CPU 120. At the time of color printing, CPU 120 regulates secondary transfer roller 12 to be in contact with intermediate transfer belt 2 at a timing after the toner images of respective colors formed on photoreceptor 3 are primary-transferred to intermediate transfer belt 2 and toner images of four colors are superposed on intermediate transfer belt 2 and before the front end of four-color toner image (leading position in the rotating direction of intermediate transfer belt 2) reaches the second transfer portion. By the time the front end of four-color toner image reaches the secondary transfer portion, secondary transfer roller 12 is in contact with intermediate transfer belt 2 and, therefore, the sheet of paper fed by the feeding unit and passes through secondary transfer roller 12 and feed roller mentioned above is brought into tight contact with intermediate transfer belt 2. As the bias voltage described above is applied to secondary transfer roller 12 in this state, the four-color toner image formed by toner images of respective colors superposed on intermediate transfer belt is transferred to the sheet of paper. This transfer is referred to as secondary transfer. Fixing roller 13 fixes the secondary-transferred toner image on the sheet of paper.

At a portion of intermediate transfer belt 2 supported by feed roller 6, a belt cleaner 5 is arranged. Belt cleaner 5 includes a cleaner contact/separation mechanism (FIGS. 2 to 4) for operating belt cleaner 5. The cleaner contact/separation mechanism operates belt cleaner 5 in accordance with a control signal from CPU 120 (FIG. 8). By its operation, a cleaner blade 51 (FIGS. 2 to 4) is brought into contact with or separated from intermediate transfer belt 2.

Specifically, while the cleaner blade 51 is in contact with intermediate transfer belt 2, the cleaner contact/separation mechanism operates belt cleaner 5 before the toner images of respective colors formed on photoreceptor 3 are primary-transferred successively to intermediate transfer belt 2 and superposed. As a result, while the toner images of respective colors are primary-transferred successively to intermediate transfer belt 2 and superposed, cleaner blade 51 is kept separated from intermediate transfer belt 2. When the rear end of toner image primary-transferred to intermediate transfer belt 2, that is, the trailing position of primary-transferred toner image in the rotating direction of intermediate transfer belt, passes through the cleaner portion, the cleaner contact/separation mechanism operates belt cleaner 5. As a result, after the rear end of toner image passed the cleaner portion, cleaner blade 51 is brought into contact with intermediate transfer belt 2. As the cleaner blade 51 is brought into contact with intermediate transfer belt 2 at this timing, residual toner on intermediate transfer belt 2 after secondary transfer is scraped off.

A density sensor 18 is provided near the intermediate transfer belt 2. Density sensor 18 irradiates the surface of intermediate transfer belt 2 with light from an LED (Light Emitting Diode) in accordance with a control signal from CPU 120 (FIG. 8), and detects light reflected from the surface of intermediate transfer belt 2. The detection signal is output to CPU 120. Based on the detection signal, CPU 120 calculates toner density of toner image on intermediate transfer belt 2.

Figure 2:
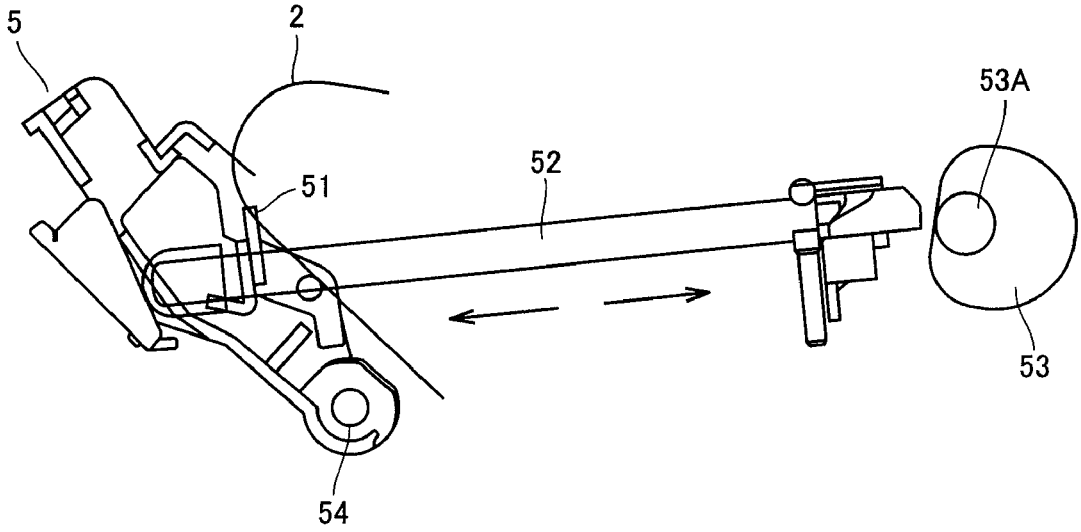
FIGS. 2 to 4 illustrate structures of a cleaner contact/separation mechanism included in the printer shown in FIG. 1.

Referring to FIG. 2, belt cleaner 5 is provided with cleaner blade 51. Belt cleaner is rotatable about a shaft portion 54.

The cleaner contact/separation mechanism includes a shaft 52 and a cum 53. One end of shaft 52 is in contact with belt cleaner 5. Cum 53 has a rotation shaft 53A, of which position relative to intermediate transfer belt 2 is fixed. Cum 53 rotates about rotation shaft 53A. The other end of shaft 52 is, at least when an end of cum 53 is at a rotational position furthest from the rotation shaft 53 in the direction of rotation of shaft 52, in contact with the end of cum 53. Therefore, axial movement of shaft 52 caused by the rotation of cum 53 is transmitted to belt cleaner 5 by shaft 52. As the shaft 52 moves, belt cleaner 5 repeats rotational movement in a prescribed angle, with shaft 54 being the center of rotation. As a result, belt cleaner 5 moves to a position away from or a position close to the intermediate transfer belt 2, as shaft 52 moves. When belt cleaner 5 moves to a position away from intermediate transfer belt 2, cleaner blade 51 is separated from intermediate transfer belt 2. When belt cleaner 5 is moved to a position close to intermediate transfer belt 2, cleaner blade 51 is in contact with intermediate transfer belt 2.

Figure 3:
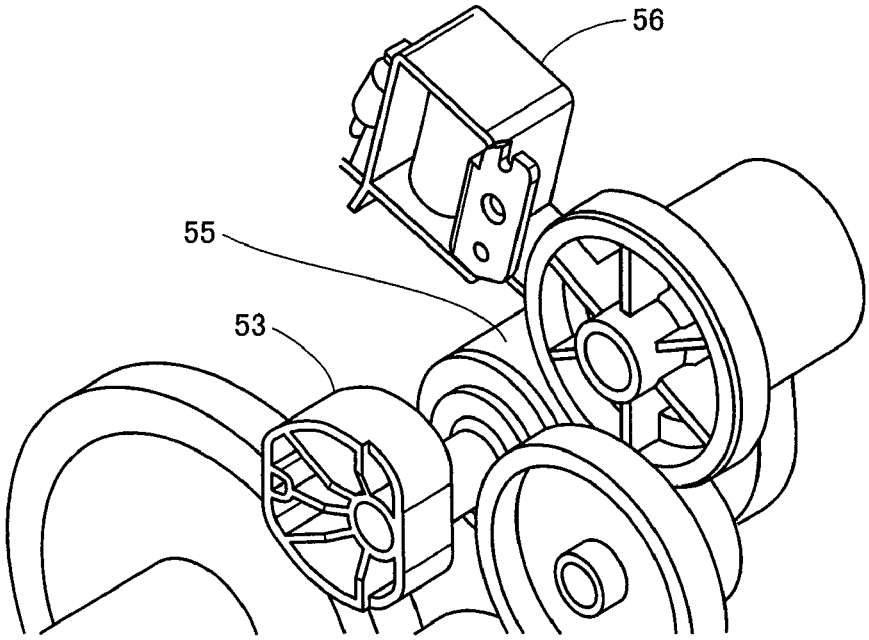
Figure 4:
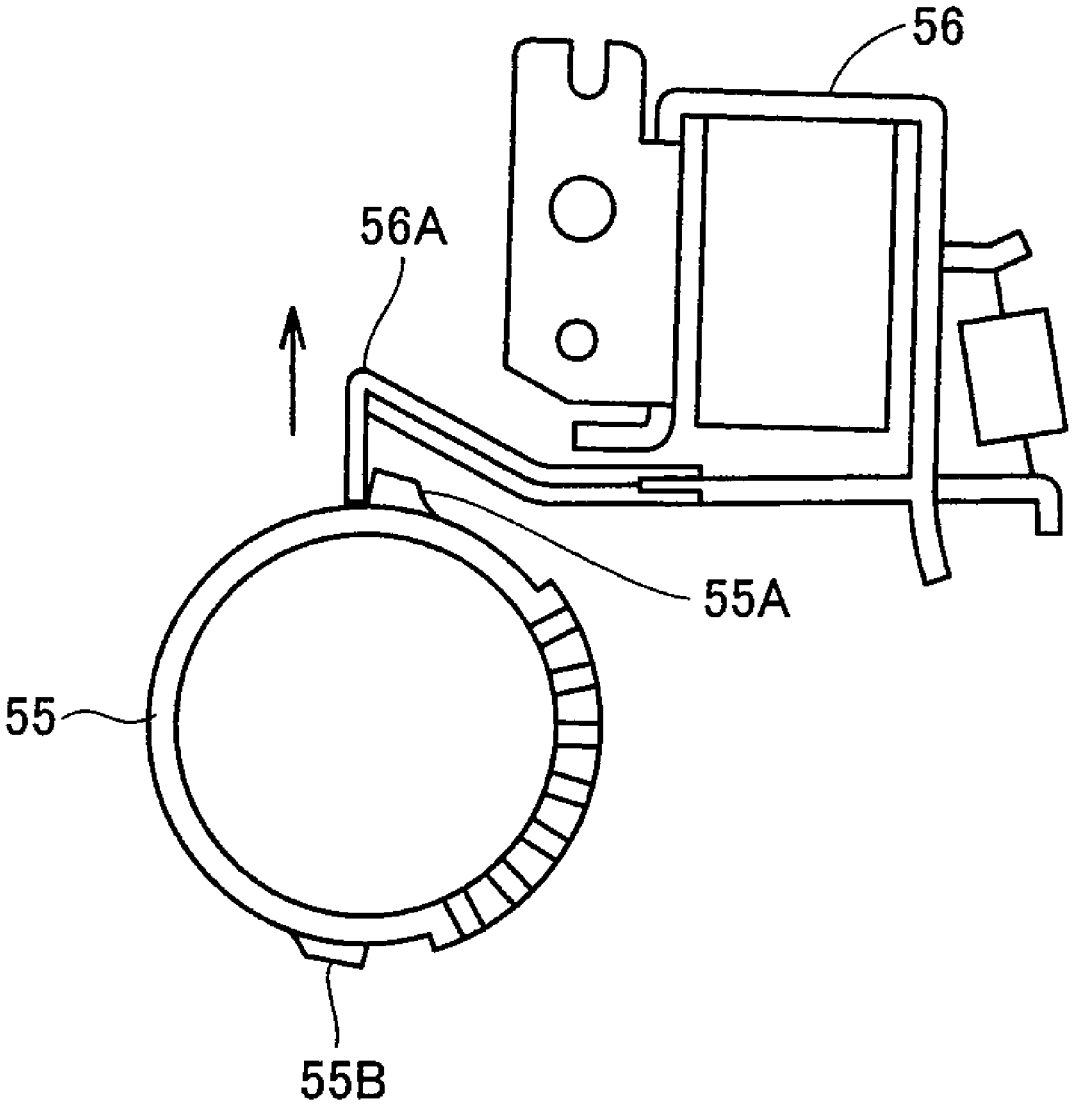

Referring to FIG. 3, cum 53 is connected to a clutch 55, which is coupled to a driving motor, not shown, and driven in accordance with a control signal from CPU 120. Cum 53 converts rotation of clutch 55 to a radial movement. Clutch 55 is rotated by the afore-mentioned driving motor driven in accordance with the control signal from CPU 120. A contact/separation solenoid 56 included in the cleaner contact/separation mechanism controls rotation of clutch 55 in accordance with a control signal from CPU 120. Specifically, with reference to FIG. 4, clutch 55 includes, as a switching mechanism, a contact claw 55A and separation claw 55B provided outward on diametrically opposite positions of clutch 55. Contact/separation solenoid 56 includes a stopper 56A at a position that can interfere with contact claw 55A or separation claw 55B. In accordance with a control signal from CPU 120, contact/separation solenoid 56 outputs a control signal for operating stopper 56A. In accordance with a control signal from contact/separation solenoid 56, stopper 56A temporarily moves to a direction indicated by an arrow in the figure, and returns to the original position thereafter. As shown in FIG. 4, when stopper 56A is at a position interfering with contact claw 55A, clutch 55 stops rotation, as contact claw 55A abuts stopper 56A. When stopper 56A operates as described above in accordance with the control signal from contact/separation solenoid 56, interference between contact claw 55A and stopper 56A is eliminated, and clutch 55 half-turns to a position where separation claw 55B interferes with stopper 56A. Thereafter, stopper 56A returning to the original position interferes with separation claw 55B, and clutch 55 stops rotation as separation claw 55B abuts stopper 56A. Half-turn of clutch 55 corresponds to half-turn of cum 53.

Figure 5A:
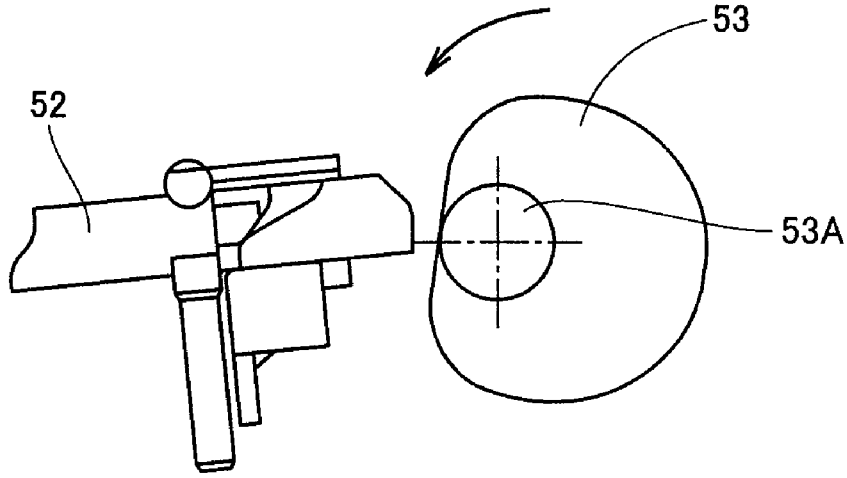
FIGS. 5A to 7B illustrate an operation of a belt cleaner attained by the cleaner contact/separation mechanism.

FIG. 5A represents a positional relation between cum 53 and shaft 52, when contact claw 55A interferes with stopper 56A as shown in FIG. 4 and clutch 55 stops its rotation. Rotational position of cum 53 is fixed such that it has the positional relation as shown in FIG. 5A to one end of shaft 52 when the rotational position of clutch 55 is as shown in FIG. 4, that is, the length from cum 53 to one end of shaft 52 becomes the longest.

Figure 5B:
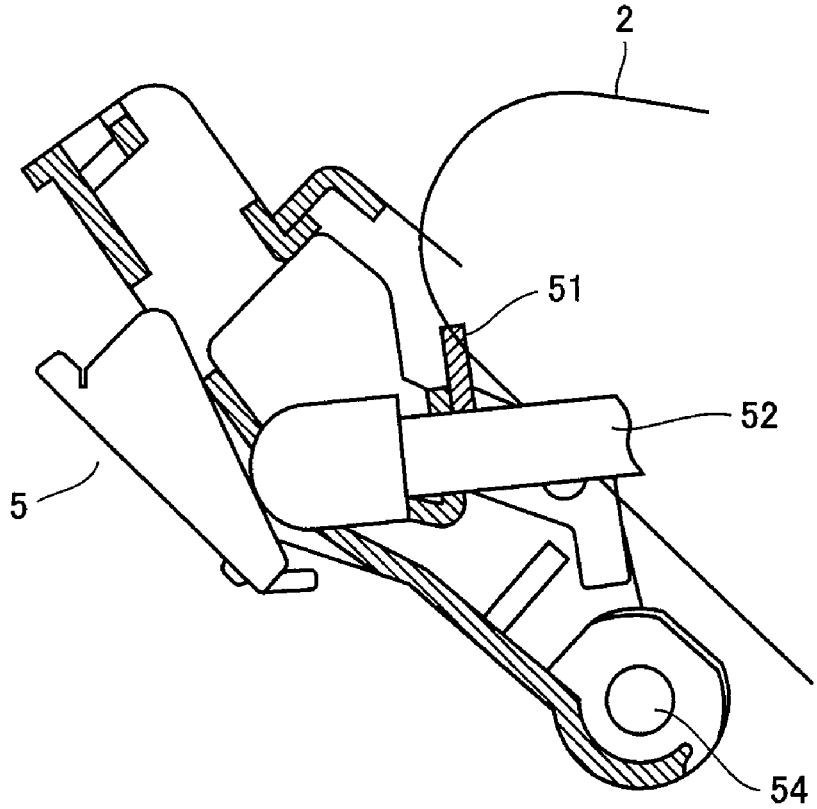

Referring to FIG. 5A, at this time, the end of cum 53 does not interfere with shaft 52. Therefore, axial force is not transmitted to shaft 52, and in this state, shaft 52 does not press belt cleaner 5. With respect to intermediate transfer belt 2, belt cleaner 5 is set to a position at which cleaner blade 51 is in contact with intermediate transfer belt 2 in this state, as shown in FIG. 5B.

From the state shown in FIG. 4, when stopper 56A temporarily moves in the direction of the arrow and contact claw 55A is released from stopper 56A, clutch 55 is rotated by a driving motor, not shown. As clutch 55 rotates, cum 53 rotates counter-clockwise as indicated by an arrow in FIG. 5A, about rotation shaft 53A. Positional relation between cum 53 and shaft 52 changes from one shown in FIG. 5A to the one shown in FIG. 6A.

Figure 6A:
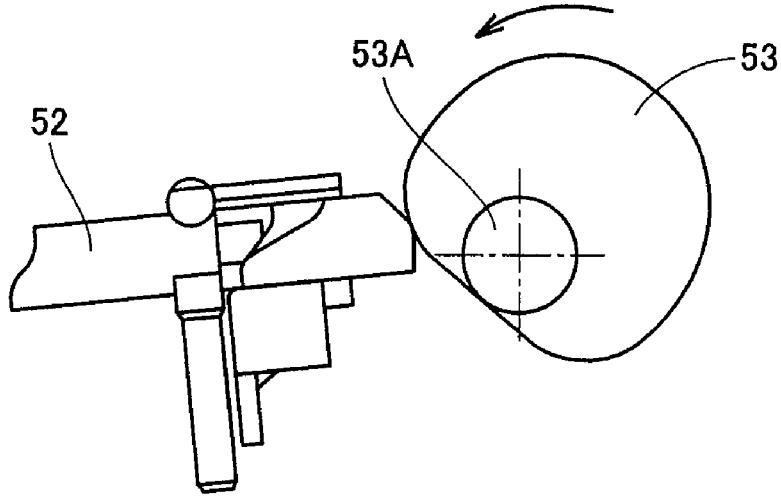
Figure 6B:
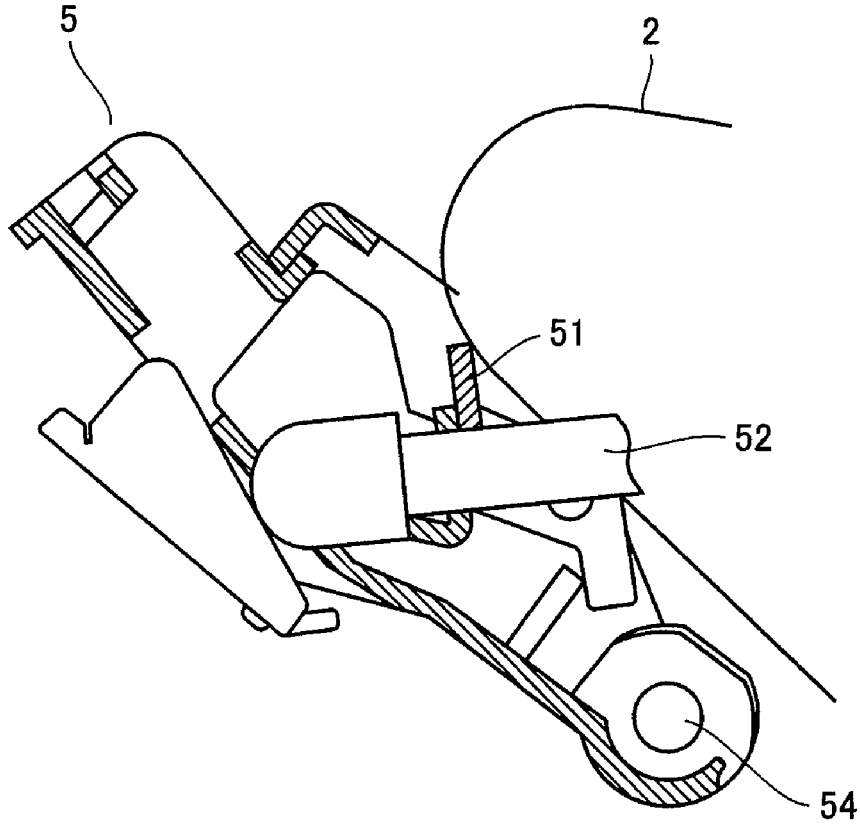

FIG. 6A shows a relation between cum 53 and shaft 52 while contact claw 55A shown in FIG. 4 is released from stopper 56A and clutch 55 is rotating until separation claw 55B comes to a position that interferes with stopper 56A. Here, referring to FIG. 6A, as the cum 53 rotates, length from rotation shaft 53A to an end of cum 53 in the direction of shaft 52 increases, and the end of cum 53 comes to be in contact with the end of shaft 52. When cum 53 further rotates from this state, shaft 52 is pressed to the direction of belt cleaner 5. Therefore, in this state, shaft 52 gradually presses belt cleaner 5. As a result, belt cleaner 5 starts to rotate in a direction away from intermediate transfer belt 2, with shaft portion 54 being the axis of rotation, as shown in FIG. 6B. Accordingly, cleaner blade 51 is gradually separated from intermediate transfer belt 2.

When clutch 55 is rotated by a driving motor, not shown, and separation claw 55B reaches a position interfering with stopper 56A, separation claw 55B abuts stopper 56A and rotation of clutch 55 stops. Accordingly, cum 53 rotates counter-clockwise as indicated by an arrow in FIG. 6A, about rotation shaft 53A. Then, positional relation between cum 53 and shaft 52 changes from one shown in FIG. 6A to one shown in FIG. 7A.

Figure 7A:
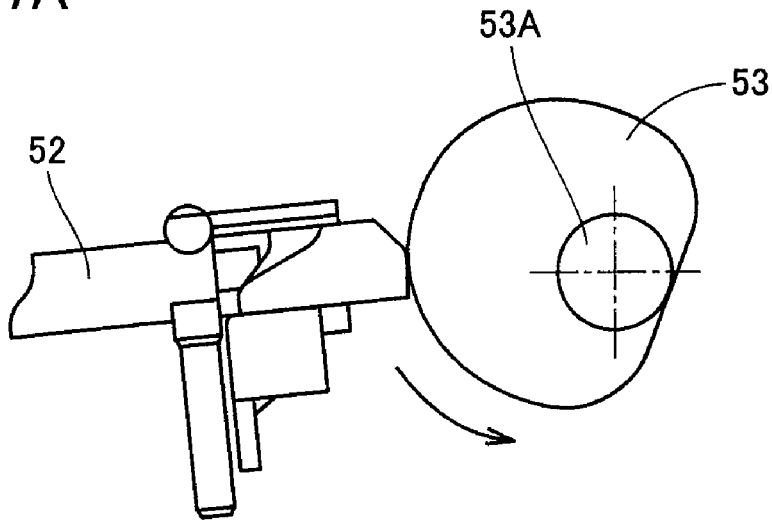
Figure 7B:
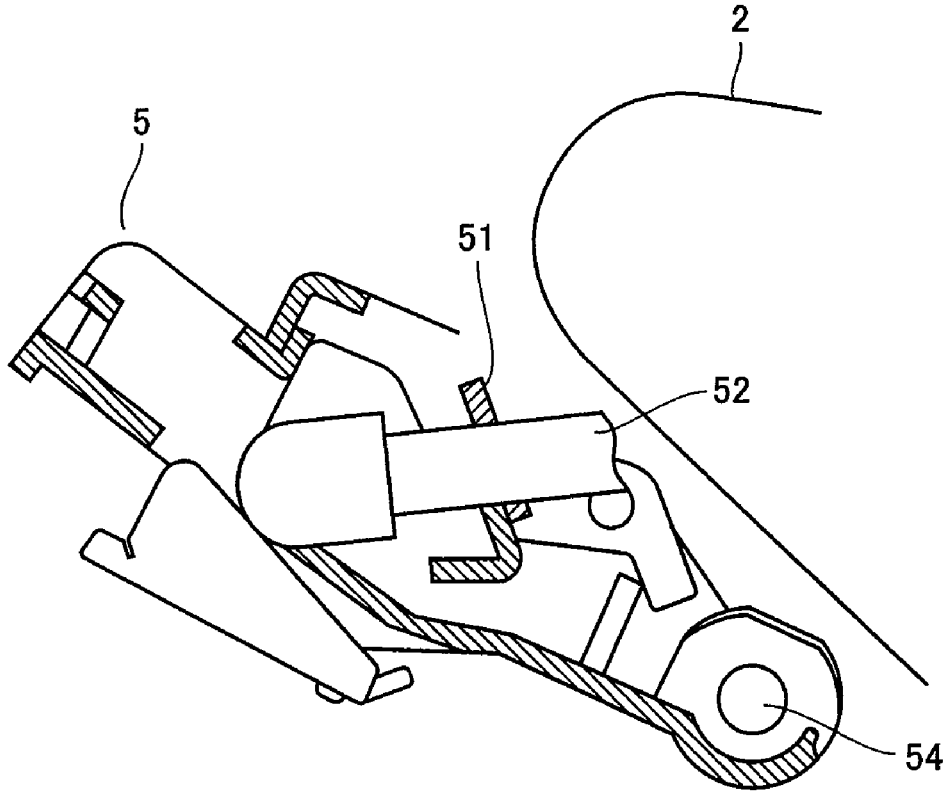

FIG. 7A shows positional relation between cum 53 and shaft 52, when separation claw 55B interferes with stopper 56A and clutch 55 stops its rotation. Preferably, at this time, the length from the rotation shaft 53A to the end of cum 53 in the direction of shaft 52 is the longest. Here, referring to FIGS. 7A and 7B, belt cleaner 5 is pressed by shaft 52, and rotates until cleaner blade 51A is fully separated from intermediate transfer belt 2, with shaft portion 54 being the axis of rotation. When clutch 55 stops its rotation in this state, cleaner blade 51 is kept separated from intermediate transfer belt 2. Thereafter, when separation claw 55B is released from stopper 56A, clutch 55 is rotated by the driving motor, not shown. As clutch 55 rotates, cum 53 rotates counter-clockwise as indicated by an arrow in FIG. 7A, about rotation shaft 53A. As the cum 53 rotates, pressure to belt cleaner 5 from shaft 52 is lost, and therefore, belt cleaner 5 rotates in a direction that cleaner blade 51 is brought into contact with intermediate transfer belt 2, with shaft portion 54 being the axis of rotation, to a state shown in FIG. 5B.

As described with reference to FIGS. 5A to 7B, in printer 100A, by operating the cleaner contact/separation mechanism, specifically, the contact/separation solenoid 56 for a prescribed time period, the state of contact/separation of cleaner blade 51 to/from intermediate transfer belt 2 is switched by the switching mechanism. The prescribed time period is, for example, 100 ms. The prescribed time period corresponds to the time for half-turning the clutch 55. As the operation of cleaner contact/separation mechanism switches the contact state to the separation state or the separation state to the contact state, the state after switching is determined by the state before switching. Therefore, it is necessary to determine at the start of operation of cleaner contact/separation mechanism whether cleaner blade 51 is in the contact state or separate state. Therefore, in printer 100A, at timing of starting or recovering operation such as at the time of power on or when body cover, not shown, is closed, the state of cleaner blade 51 is determined. Thereafter, the state of cleaner blade 51 is set to the default state of contact (or separation), and the printing operation or the like is executed.

Referring to FIG. 8, printer 100A includes an operation panel 111 for displaying and receiving an input of operation instruction. Operation panel 111 includes a display panel 111*a* for displaying the device state and the like, and input keys 111*b* for inputting various settings.

Printer 100A further includes a printing unit 112 for printing images, CPU 120 for overall control of printer 100A, and a RAM (Random Access Memory) 121, a ROM (Read Only Memory) 122 and a storage unit 123 as storage devices, which are connected to a bus 114.

Storage unit 123 is formed of a non-volatile memory such as an EEPROM (Electrically Erasable and Programmable Read Only Memory), and stores and holds various adjustment values in printer 100A and various setting values set by the user. RAM 121, ROM 122 or storage unit 123 stores a program executed by CPU 120. By executing the program, CPU 120 generates control signals in accordance with the program, and outputs control signals to each of the mechanism controlling rotation of driving motors, exposure unit 9, mechanism for rotating the development rack, density sensor 18 and cleaner contact/separation mechanism, at timings in accordance with the program.

Figure 9:
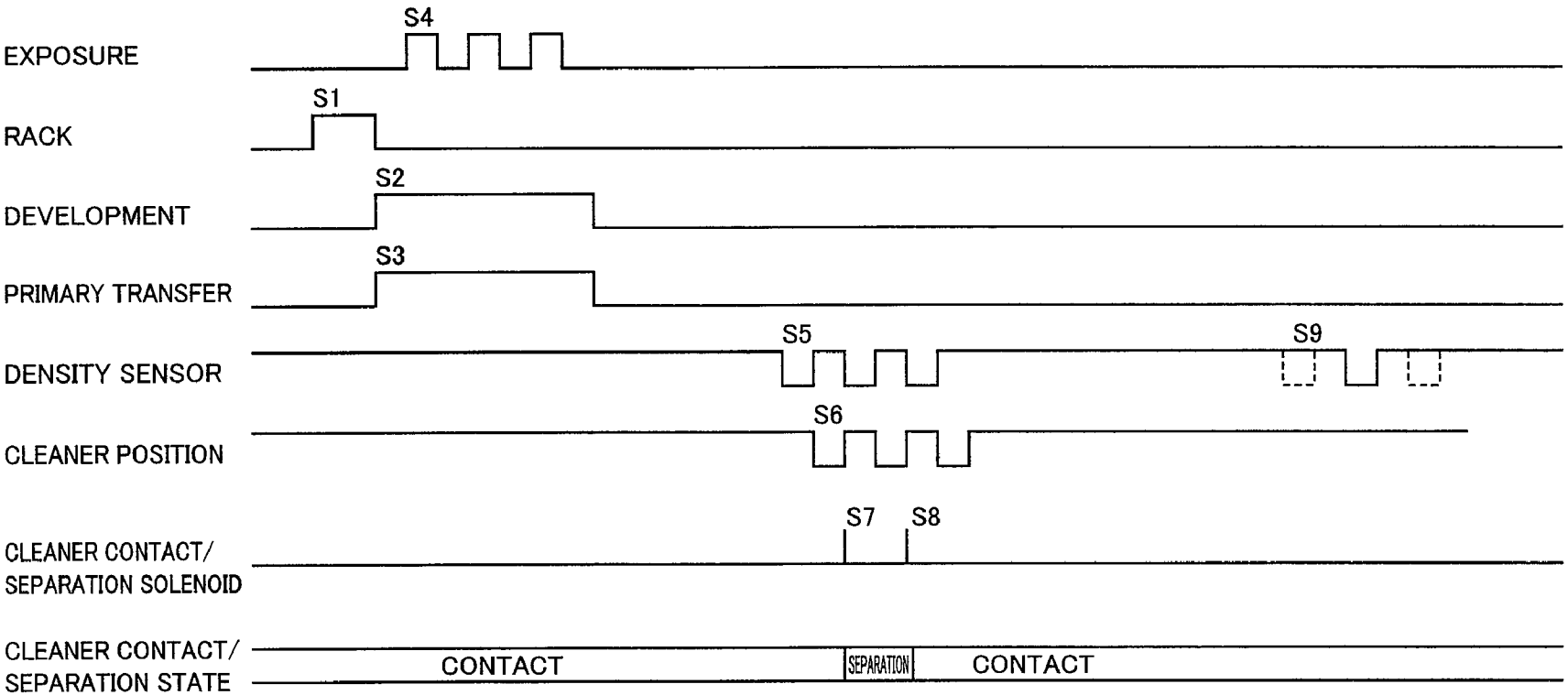
FIGS. 9 to 11 illustrate a determination process performed when the power is turned on or body cover is closed, as a timing of starting/recovering operation, and the state of contact/separation of cleaner blade to/from the intermediate transfer belt, in the printer in accordance with the first embodiment of the present invention.
Figure 10:
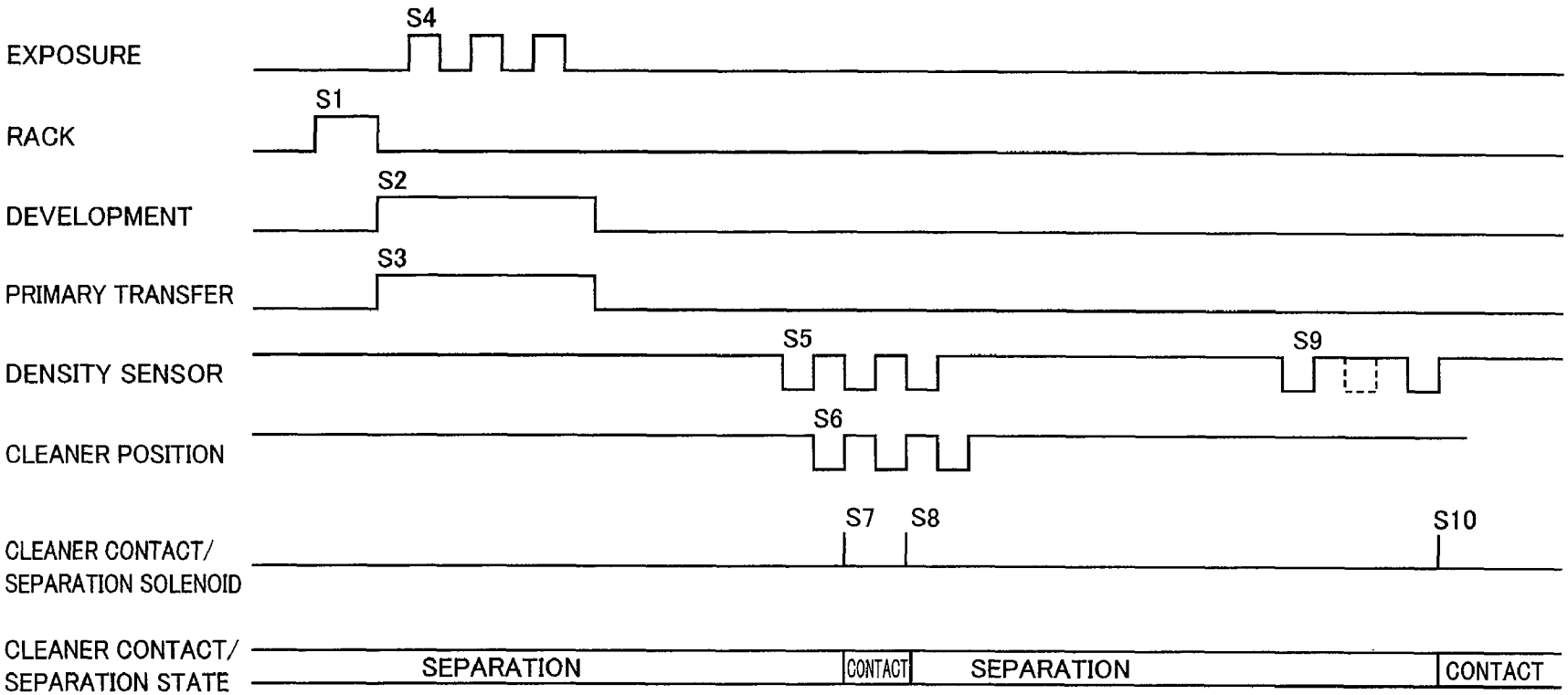

Referring to FIGS. 9 and 10, a determining process performed when the power is turned on or when a body cover, not shown, is closed as the timing of starting/recovering operation, and the state of contact/separation of cleaner blade 51 to intermediate transfer belt 2, in printer 100A will be described. In the process shown in FIGS. 9 and 10, it is assumed that, after the state of cleaner blade 51 is determined, the cleaner blade 51 is set to the state in which cleaner blade 51 is in contact with intermediate transfer belt 2, as the default state. FIGS. 9 and 10 each show operation timings of various mechanisms and the state of contact/separation of cleaner blade 51 to intermediate transfer belt 2, with time passing from left to right. These mechanisms operate as various portions shown in FIGS. 1 to 8 are controlled in accordance with control signals output by CPU 120 executing the program stored in ROM 122 or the like. In FIGS. 9 and 10, process steps S1 to S9 are the same, and dependent on the determination at step S9, the flow branches to the process of FIG. 9 or FIG. 10.

Referring to FIGS. 9 and 10, when power-on is detected, or when closing of a body cover, not shown, from the open state is detected, CPU 120 outputs a control signal to the mechanism for rotating the development rack (step S1). In the standby state, the development rack is stopped at a prescribed standby position. At step S1 mentioned above, CPU 120 outputs a control signal for rotating the development rack from the standby position to the position for developing cartridge 15. Consequently, the development rack rotates from the standby position to the position for developing cartridge 15. Preferably, CPU 120 rotates the development rack to the position for developing the cartridge 15 having largest amount of remaining toner among cartridges 15Y, 15M, 15C and 15K corresponding to respective colors.

Next, CPU 120 outputs control signals to the mechanism for controlling rotation of the development motor for rotating the development roller and to exposure unit 9, for forming a toner patch on the surface of photoreceptor 3 and for performing primary transfer of the patch to intermediate transfer belt 2 (steps S2, S3, S4). Consequently, a toner patch of the color corresponding to the cartridge at the development position of the development rack that has been rotated in accordance with the control signal at step S1, is primary-transferred to intermediate transfer belt 2.

At steps S2, S3 and S4, CPU 120 outputs the control signal for exposure a number of times, to exposure unit 9. Consequently, a plurality of toner patches are formed on the surface of photoreceptor 3, and the plurality of toner patches are primary-transferred to intermediate transfer belt 2, aligned in the direction of rotation of transfer belt 2. Preferably, the control signal for exposure is output three times, as shown in FIGS. 9 and 10. As a result, three toner patches are formed on the surface of photoreceptor 3, and three toner patches are primary-transferred to intermediate transfer belt 2, aligned in the direction of rotation of transfer belt 2. In the present embodiment, it is assumed that three toner patches are primary-transferred to intermediate transfer belt 2, and from the upstream side to the downstream side of rotation of intermediate transfer belt 2, the toner patches will be referred to as the first, second and third toner patches.

In the present embodiment, a toner patch on intermediate transfer belt 2 is assumed to have the length (width) of 10 mm in the direction of rotation of intermediate transfer belt 2. The distance between the first and second toner patches and the distance between the second and third toner patches are determined in consideration of time necessary for the cleaner contact/separation mechanism for operating belt cleaner 5 (operation time), a margin time provided in case operation of belt cleaner 5 should be delayed, and rotation rate of intermediate transfer belt 2. In the present embodiment, the margin time is set to be 200 ms. These are set in advance, and stored in a prescribed storage device such as storage unit 123. These values may be input or may be changed by a specific user, such as an administrator, through a specific operation.

The operation time mentioned above corresponds to the longer one of the operation time (separation) of belt cleaner 5 for separating cleaner blade 51 from the contact state with intermediate transfer belt 2 and the operation time (contact) of belt cleaner 5 for bringing the cleaner blade 51 from the separate state into contact with the belt. Specifically, it corresponds to the time from when the cleaner contact/separation mechanism starts operation of the belt cleaner 5 until the operation is completed. In the present embodiment, the time necessary for separation is assumed to be 250 ms and the time necessary for contact is assumed to be 280 ms. Therefore, in the present embodiment, the operation time mentioned above is set to 280 ms.

Next, CPU 120 outputs a control signal for irradiating the surface of intermediate transfer belt 2 with LED light, to density sensor 18, at any timing while the intermediate transfer belt 2 is rotating to a position where the first toner patch reaches the area of density sensor 18. Here, the surface of intermediate transfer belt 2 may be irradiated with LED light at least by the time when the first toner patch reaches density sensor 18. The time from the end of primary transfer of the toner patch to the output of the control signal mentioned above may be set in advance in CPU 120.

As a detection signal, density sensor 18 inputs a voltage signal corresponding to the intensity of light reflected from the surface of intermediate transfer belt 2, as an analog value, to CPU 120. By way of example, if the toner patch on intermediate transfer belt 2 has high density, a voltage signal close to 0V is input, and if it has low density, a voltage signal close to 5V is input. CPU 120 stores a threshold value in advance, and compares the voltage value obtained from the voltage signal input by density sensor 18 with the threshold value, to determine whether there is a toner patch on intermediate transfer belt 2 or not (step S5). Specifically, CPU 120 stores, for example, 2.5V as the threshold value. CPU 120 calculates the voltage value as an average value of voltage signals input from density sensor 18 detecting, in the 10 ms period, the light reflected from the toner patch having the width of 10 mm. If the calculated voltage value is not higher than the threshold value of 2.5V, CPU 120 determines that there is a toner patch on intermediate transfer belt 2, and otherwise, determines that there is no toner patch.

At step S5, if determination of no toner patch is made the same number of times as the number of exposure by exposure unit 9 at step S4, that is, if it is determined that none of the first to third patches exist on intermediate transfer belt 2, it is considered that no toner remains or the remaining amount of toner is smaller than a prescribed amount, in cartridge 15 at the developing position of the development rack that has been rotated in accordance with the control signal at step S1. In that case, CPU 120 returns the process to step S1, and outputs a control signal to development rack to rotate the rack to the development position of the next cartridge 15, and repeats process steps S1 to S5. At this time, preferably, CPU 120 rotates the development rack to the development position of a cartridge having the amount of remaining toner second largest to the cartridge selected last time.

Storage unit 123 stores in advance lengths of various portions of intermediate transfer belt 2, such as the length (for example, 50 mm) of intermediate transfer belt 2 from density sensor 18 to belt cleaner 5, the above-described width of toner patch (10 mm), rotation rate of intermediate transfer belt 2 and the like. Therefore, by providing a timer and by counting time lapse from a prescribed timing, it is possible for CPU 120 to detect to which position in the rotational direction of intermediate transfer belt the position of primary transfer of each of the toner patches corresponds.

Specifically, after the first toner patch on intermediate transfer belt 2 reached the sensing area of density sensor 18 and density detection started at step S5, when a time period necessary for intermediate transfer belt 2 to move the length from density sensor 18 to belt cleaner 5 (for example, 50 mm) and the length corresponding to toner patch width (10 mm) has passed, the first toner patch passes through belt cleaner 5. Therefore, CPU 120 counts the lapse of time from a timing at which the position of each toner patch (preferably, the first toner patch) on the intermediate transfer belt 2 can be identified, and whereby it can detect the timing at which each of the first to third toner patches reaches belt cleaner 5 and passes through belt cleaner 5 (step S6). Preferably, CPU 120 counts the lapse of time from the timing at which the detection signal was first input from density sensor 18, to detect the timing at which each of the first to third toner patches reaches belt cleaner 5 and passes through belt cleaner 5.

CPU 120 counts the lapse of time from the timing when the detection signal was first input from density sensor 18. After detecting the lapse of time, that is, detecting that the first toner patch has passed through belt cleaner 5, CPU 120 outputs at that timing the control signal to have the cleaner contact/separation mechanism operate belt cleaner 5 (step S7). Thereafter, CPU 120 continues counting and detects that the second toner patch has passed through belt cleaner 5 and, at that timing, outputs the control signal to have the cleaner contact/separation mechanism operate belt cleaner 5 (step S8).

Thereafter, when intermediate transfer belt 2 rotates and the toner patch reaches the sensing area of density sensor 18, CPU 120 receives input of voltage signal from density sensor 18. CPU 120 determines whether there is a toner patch on intermediate transfer belt 2 or not, based on the voltage signal from sensor 18, in the similar manner as at step S5 (step S9).

As shown in FIG. 9, when cleaner blade 51 is in the state of contact with intermediate transfer belt 2 as the initial state, it follows that the cleaner blade 51 is kept in contact with intermediate transfer belt 2 until the first toner patch passes through belt cleaner 5. When belt cleaner 5 operates in accordance with the control signal of step S7, cleaner blade 51 is separated from intermediate transfer belt 2 after the first toner patch passed through belt cleaner 5 and before the second toner patch reaches belt cleaner 5. Thereafter, when belt cleaner 5 operates in accordance with the control signal of step S8, cleaner blade 51 is brought into contact with intermediate transfer belt 2 after the second toner patch passed through belt cleaner 5 and before the third toner patch reaches belt cleaner 5. Thus, the first and third toner patches are scraped off from intermediate transfer belt 2 by cleaner blade 51, and the second toner patch is left on the intermediate transfer belt 2.

As shown in FIG. 10, when cleaner blade 51 is in the state separated from intermediate transfer belt 2 as the initial state, it follows that the cleaner blade 51 is kept separate from intermediate transfer belt 2 until the first toner patch passes through belt cleaner 5. When belt cleaner 5 operates in accordance with the control signal of step S7, cleaner blade 51 comes to be in contact with intermediate transfer belt 2 after the first toner patch passed through belt cleaner 5 and before the second toner patch reaches belt cleaner 5. Thereafter, when belt cleaner 5 operates in accordance with the control signal of step S8, cleaner blade 51 is separated from intermediate transfer belt 2 after the second toner patch passed through belt cleaner 5 and before the third toner patch reaches the belt cleaner 5. Consequently, the second toner patch is scraped off by cleaner blade 51 from intermediate transfer belt 2, and the first and third toner patches are left on intermediate transfer belt 2.

CPU 120 continues counting described above and assume that, as shown in FIG. 9 at step S9, it determines that the toner patch does not exist at the positions of the first toner patch and the third toner patch on intermediated transfer belt 2 and a toner patch exists at the position of the second toner patch, based on the position of intermediate transfer belt 2 detected from the count value and on presence/absence of toner patch determined from the voltage signals from density sensor 18. In FIG. 9, the timing of determination that toner patch is absent is represented by dotted lines. Here, it is determined that belt cleaner 5 has operated such that the first and third toner patches have been scraped off from the intermediate transfer belt 2 and only the second toner patch is left on intermediate transfer belt 2. Therefore, when the presence/absence of toner patches is determined as shown in FIG. 9, CPU 120 determines at step S9 that the cleaner contact/separation mechanism is operating normally in accordance with control signals applied at steps S7 and S8 and that in the initial state, cleaner blade 51 is in contact with intermediate transfer belt 2.

On the other hand, assume that at step S9, CPU 120 determines that toner patches exist at positions of the first and third toner patches on intermediate transfer belt 2 and that a toner patch does not exist at the position of second toner patch, as shown in FIG. 10. In FIG. 10 also, the timing of determination that toner patch is absent is represented by dotted lines. Here, it is determined that belt cleaner 5 has operated such that the second toner patch has been scraped off from the intermediate transfer belt 2 and the first and third toner patches are left on intermediate transfer belt 2. Therefore, when the presence/absence of toner patches is determined as shown in FIG. 10, CPU 120 determines at step S9 that the cleaner contact/separation mechanism is operating normally in accordance with control signals applied at steps S7 and S8 and that in the initial state, cleaner blade 51 is separated from intermediate transfer belt 2.

If it is determined at step S9 that in the initial state, cleaner blade 51 is in contact with intermediate transfer belt 2 as shown in FIG. 9, CPU 120 proceeds to a succeeding process, without causing any operation of belt cleaner 5. If it is determined at step S9 that in the initial state, cleaner blade 51 is separated from intermediate transfer belt 2 as shown in FIG. 10, CPU 120 outputs a control signal to the cleaner contact/separation mechanism for operating belt cleaner 5 (step S10). Consequently, cleaner blade 51 comes to be in the default state, in which it is in contact with intermediate transfer belt 2.

After the cleaner blade 51 is brought into contact with intermediate transfer belt 2 at step S10, preferably, CPU 120 rotates intermediate transfer belt 2 at least once, to clean the intermediate transfer belt 2. Specifically, if cleaner blade 51 is separate from intermediate transfer belt 2 in the initial state, it becomes necessary after the determination of step S9 to perform control for operating belt cleaner 5 at step S10 and further to perform control for rotating intermediate transfer belt 2 at least once. Therefore, as the initial state, the state in which cleaner blade 51 is in contact with intermediate transfer belt 2 is preferred than the state in which it is separated from the belt, as the required amount of processing for determination and process time can be reduced.

Figure 11:
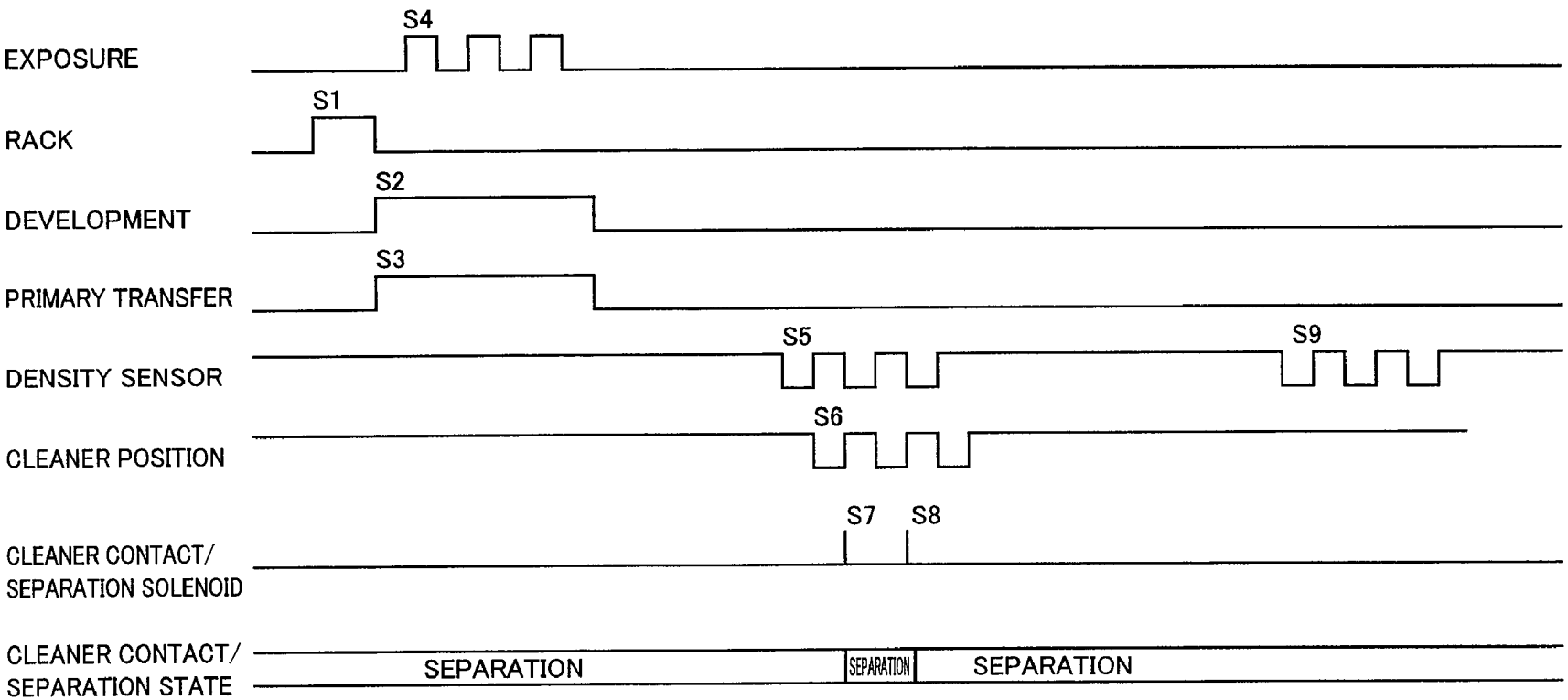

The process of CPU 120 when determination of neither FIG. 9 nor FIG. 10 is made at step S9 will be described with reference to FIG. 11.

Assume that at step S9, determination is other than alternate existence of toner patches at the first to third toner patches as shown in FIG. 9 or FIG. 10. For instance, if it is determined at step S9 that toner patches exist on all of the first to third positions, as shown in FIG. 11, CPU 120 determines that the cleaner contact/separation mechanism is malfunctioning. If such a determination is made, it is considered that cleaner blade 51 is separated from the intermediate transfer belt 2 at the initial state, belt cleaner 5 has not operated and cleaner blade 51 is kept separated from intermediate transfer belt 2. As another example, if it is determined at step S9 that the first and second toner patches exist while a toner patch does not exist at the position of the third toner patch, or that a toner patch does not exist at the position of the first toner patch and the second and third toner patches exist, CPU also determines that the cleaner contact/separation mechanism is malfunctioning. Further, if it is determined that toner patch does not exist at any of the first to third toner patch positions, it may be considered a malfunction of cleaner contact/separation mechanism, rather than toner empty of cartridge 15.

If it is determined by CPU 120 at step S9 that the cleaner contact/separation mechanism is malfunctioning, preferably, CPU 120 performs a process for giving an alarm to that effect, for example, giving an indication on a display panel 111*a*.

In the specific example above, three toner patches are formed on the surface of photoreceptor 3 as the plurality of toner patches at step S4, and primary-transferred to intermediate transfer belt 2 at step S3. The number of toner patches, however, is not limited to three, and it may be any number not smaller than two.

For instance, assume that there are two toner patches. Specifically, assume that first and second toner patches are primary-transferred. If it is determined at step S9 that a toner patch does not exist at the position of first toner patch and the second toner patch does exist, CPU 120 determines that cleaner blade 51 has been in contact with intermediate transfer belt 2 at the initial state, and that belt cleaner 5 has operated at step S7 and cleaner blade 51 has been separated from intermediate transfer belt 2. In other words, it is determined that the cleaner contact/separation mechanism is operating normally. Further, assume that at step S9, the first toner patch exists and no toner patch exists at the position of the second toner patch. In that case, CPU 120 determines that cleaner blade 51 has been separated from intermediate transfer belt 2 at the initial state, and that belt cleaner 5 has operated at step S7 and cleaner blade 51 has been brought into contact with intermediate transfer belt 2. In other words, it is determined that the cleaner contact/separation mechanism is operating normally. Further, assume that at step S9, it is determined that both first and second toner patches exist, or that toner patch does not exist at either of these positions. In that case, CPU 120 determines that cleaner contact/separation mechanism is malfunctioning.

If the number of toner patches that are primary-transferred is two, whether the cleaner contact/separation mechanism operates normally/abnormally is determined only on the operation of belt cleaner 5 for separating cleaner blade 51 from the intermediate transfer belt 2 from the contact state, or on the operation of belt cleaner 5 for bringing into contact the cleaner blade 51 to intermediate transfer belt 2 from the separate state. Therefore, it is more preferred to primarily transfer three or more toner patches as shown in the example above, since whether the cleaner contact/separation mechanism operates normally/abnormally can be determined on both operations. When three or more toner patches are transferred, it is preferred to repeat control of steps S7 and S8 so that respective toner patches pass through cleaner blade 51 with cleaner blade 51 being in the contact state and separate state alternately. In this manner, presence/absence of toner patch on intermediate transfer belt 2 is detected at step S9 and CPU 120 can determine whether or not the cleaner contact/separation mechanism operates normally.

The timing of starting/recovering operation may include a start of operation after an abnormal end of processing of printer 100A. "Abnormal end" may include paper jam, or power-off of printer 100A during printing. It is preferred that, when an operation for normal ending is performed and the printer operation ends accordingly, CPU 120 so stores in an area of which data is not erased even after power-off. By such an arrangement, it is possible to determine whether operation ended normally or abnormally last time, by making reference to the storage area at the timing of starting/recovering operation. After an abnormal end, toner may possibly be left on the surface of intermediate transfer belt 2. Therefore, if power is turned on or a body cover, not shown, is closed and the operation of printer 100A is resumed after an abnormal end, it is preferred that CPU 120 performs cleaning of the surface of intermediate transfer belt 2, before making the determination at the timing of starting/recovering operation. As for the method of cleaning, specifically, it is preferred to rotate intermediate transfer belt 2 once without operating belt cleaner 5 at the start of operation of printer 100A, and thereafter to rotate intermediate transfer belt 2 once while operating belt cleaner 5. In this manner, intermediate transfer belt 2 can be rotated once with the cleaner blade 51 in the contact state and once in the separate state, regardless of the state of cleaner blade 51 at the start of operation of printer 100A. Therefore, it is possible to bring cleaner blade 51 into contact with intermediate transfer belt 2 for cleaning, in either one rotation.

Because of the process described above performed in printer 100A, it becomes possible for CPU 120 to determine whether the cleaner contact/separation mechanism operates normally/abnormally based on the detection signal from density sensor 18, without using a sensor for detecting contact/separation of cleaner blade 51.

Modification of First Embodiment

In the example described above, the determination process is performed at the timing of starting/recovering operation, for example, when the power is turned on, or when a body cover, not shown, is closed. The process, however, may be performed at other timings. For example, the process may be performed when a print instruction is input through an input key 111*b*, when standby period of printing process exceeds a prescribed time period, or when the printing process ends.

Second Embodiment

As a second embodiment of the present invention, a tandem type color printer as an image forming apparatus will be described. It is assumed that internal configuration of printer 100B in accordance with the second embodiment is the same as that of printer 100A in accordance with the first embodiment shown in FIG. 8.

Figure 12:
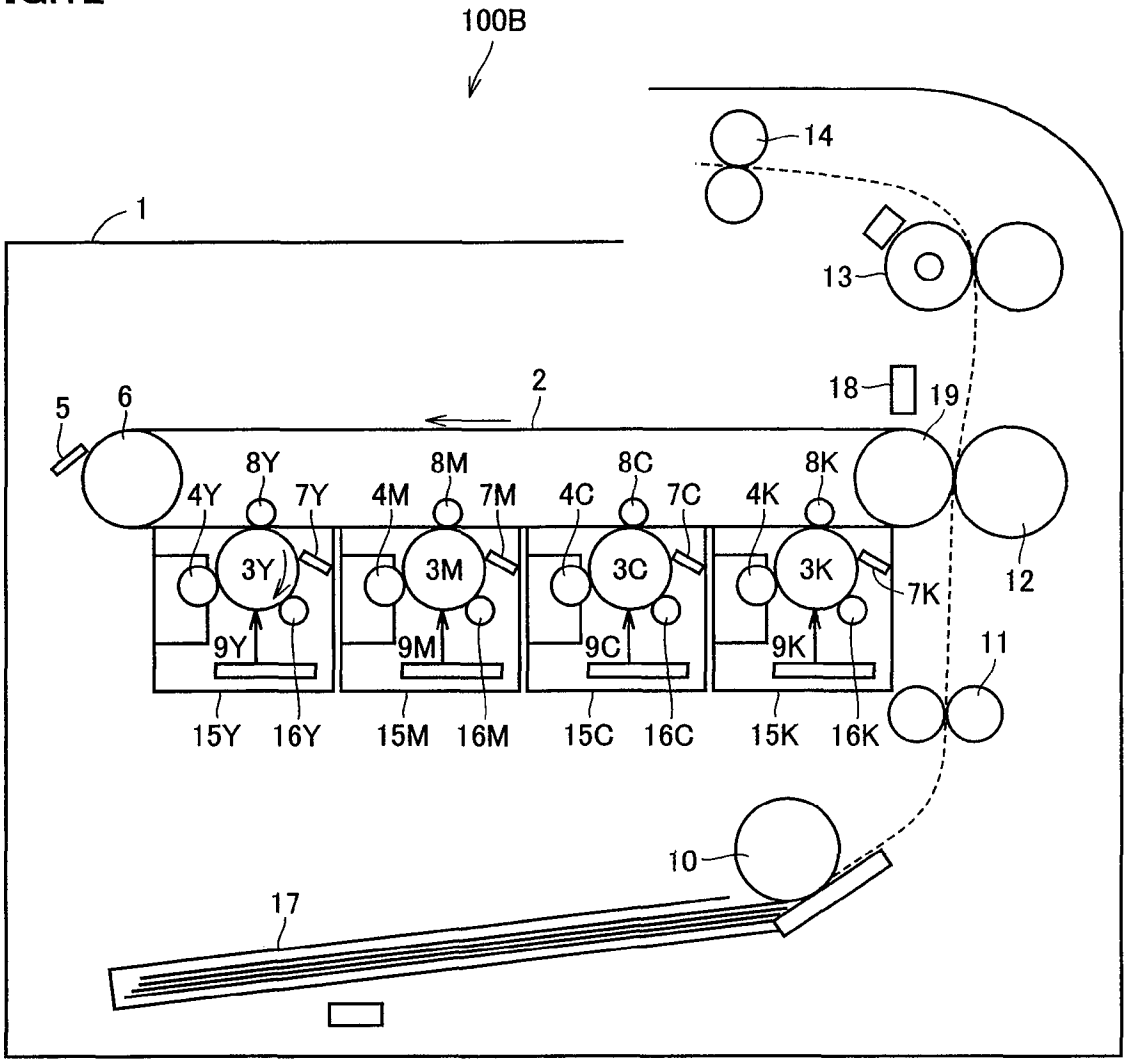
FIG. 12 schematically shows a cross-section of a tandem type color printer in accordance with a second embodiment of the present invention.

In FIG. 12, portions similar to those of printer 100A are denoted by the same reference characters. Referring to FIG. 12, approximately at the center of printer 100B, intermediate transfer belt 2 is arranged. Intermediate transfer belt 2 is suspended by a plurality of rollers including primary transfer rollers corresponding to respective colors and feed rollers 6 and 19. At least one of the plurality of rollers is a driving roller. The driving roller is coupled to a driving motor, not shown, and rotated by the driving motor. The driving motor is driven in accordance with a control signal from CPU 120 (FIG. 8). Therefore, rotation of these rollers is controlled by the control signal from CPU 120. By the rotation of these rollers, intermediate transfer belt 2 is driven and rotated counter-clockwise in the figure.

Along the intermediate transfer belt 2, cartridges 15Y, 15M, 15C and 15K (generally represented as cartridge 15) corresponding to respective colors, that is, yellow (Y), magenta (M), cyan (C) and black (K), are arranged. Here, it is assumed that toner images are transferred primarily to intermediate transfer belt 2 in this order, and cartridges are arranged in the order of 15Y, 15M, 15C and 15K from the upstream side of rotation of intermediate transfer belt 2.

Respective cartridges 15Y, 15M, 15C and 15K include photoreceptors 3Y, 3M, 3C and 3K, charging units 16Y, 16M, 16C and 16K, exposure units 9Y, 9M, 9C and 9K, developing units 4Y, 4M, 4C and 4K, and photoreceptor cleaners 7Y, 7M, 7C and 7K. These will be generally represented as photoreceptor 3, charging unit 16, exposure unit 9, developing unit 4, and photoreceptor cleaner 7. Photoreceptor 3 is coupled to a driving motor, not shown, and driven to rotate clockwise in the figure. The driving motor is driven in accordance with a control signal from CPU 120 (FIG. 8). Therefore, rotation of photoreceptor 3 is controlled by the control signals from CPU 120.

CPU 120 color-converts image signals as the object of processing to yellow (Y), magenta (M), cyan (C) and black (K), and generates digital image signals. Based on the generated digital signals, CPU 120 outputs control signals to exposure units 9 corresponding to respective colors. In accordance with the control signals from CPU 120, exposure unit 9 irradiates photoreceptor 3 with laser beams. Consequently, electrostatic latent image is formed on the surface of each photoreceptor 3 corresponding to respective colors. When an electrostatic latent image is formed on photoreceptor 3, developing unit 4 operates in accordance with a control signal from CPU 120, and supplies toner. In this manner, toner images are formed on photoreceptors 3 corresponding to respective colors.

Primary transfer rollers 8Y, 8M, 8C and 8K corresponding to respective colors are arranged from the upstream side of rotation of intermediate transfer belt 2 such that the rollers oppose to photoreceptors 3 of corresponding colors with intermediate transfer belt 2 positioned therebetween. These rollers will be generally represented as a primary transfer roller 8. Further, all primary rollers 8Y, 8M and 8C used for color printing will be generally referred to as a color primary transfer roller 8, and primary transfer roller 8K used for black, monochrome printing will be referred to as monochrome primary transfer roller 8K. A region between primary transfer roller 8 and photoreceptor 3 with intermediate transfer belt 2 interposed constitutes a primary transfer portion.

Primary transfer roller 8 presses intermediate transfer belt 2 to photoreceptor 3 so that photoreceptor 3 is brought into contact with intermediate transfer belt 2, and the toner adhered as a toner image on photoreceptor 3 is primary-transferred to intermediate transfer belt 2. In printer 100B, color primary transfer roller 8 is connected to a transfer roller contact/separation mechanism (FIGS. 13, 14). Transfer roller contact/separation mechanism operates the color primary transfer roller 8 in accordance with a control signal from CPU 120 (FIG. 8). By the operation, color primary transfer roller 8 is brought into contact with or separated from intermediate transfer belt 2. Specifically, at the time of color printing, primary transfer rollers 8Y, 8M, 8C and 8K corresponding to respective colors, including color primary transfer rollers 8, are all brought into contact with intermediate transfer belt 2. Primary transfer rollers 8Y, 8M, 8C and 8K each press intermediate transfer belt 2 to corresponding photoreceptors 3Y, 3M, 3C and 3K, respectively. Consequently, toner images of four colors are each primary-transferred to intermediate transfer belt 2 and superposed. At the time of black, monochrome printing, color primary transfer rollers 8 are separated from intermediate transfer belt 2, and only the primary transfer roller 8K corresponding to black (K) presses the intermediate transfer belt 2 to photoreceptor 3K. Primary transfer roller 8K primary-transfers the toner image of black (K) to intermediate transfer belt 2.

Cleaner 7 has a blade that is brought into contact with the surface of photoreceptor 3, and after primary transfer of the toner image of each color to intermediate transfer belt 2, it scrapes off the toner left on photoreceptor 3.

At a lower portion of printer 100B, a recording medium container unit 17 is arranged. A sheet of paper as the recording medium, contained and stored in recording medium container unit 17 is fed by a feeding unit and discharged to a paper discharge unit 1. The feeding unit consists of a paper feed roller 10, a timing roller 11, a secondary transfer roller 12, a fixing roller 13 and a paper discharge roller 14. Paper feed roller 10 is for feeding sheets of paper from recording medium container unit 17. Timing roller 11 is for temporarily stopping the fed recording medium.

Secondary transfer roller 12 is arranged to form a pair with a feed roller supporting the circular intermediate transfer belt 2 from the inside, with intermediate transfer belt 2 posed between the pair of rollers. A prescribed bias voltage is applied from a bias power supply, not shown, to secondary transfer roller 12. A region between secondary transfer roller 12 and the feed roller with intermediate transfer belt 2 interposed constitutes a secondary transfer portion. Secondary transfer roller 12 is brought into contact with, or separated from, intermediate transfer belt 2 in accordance with a control signal from CPU 120. As the secondary transfer roller 12 is brought into contact with intermediate transfer belt 2, the sheet of paper fed by the feeding unit and passes between secondary transfer roller 12 and feed roller is brought into tight contact with intermediate transfer belt 2. As the bias voltage described above is applied to secondary transfer roller 12 in this state, the toner image on intermediate transfer belt 2 is secondary-transferred to the sheet of paper. Fixing roller 13 fixes the secondary-transferred toner image on the sheet of paper.

At a portion of intermediate transfer belt 2 supported by feed roller 6, a belt cleaner 5 is arranged. When a cleaner blade 51 (not shown) included in belt cleaner 5 is brought into contact with intermediate transfer belt 2, toner left on intermediate transfer belt 2 after secondary transfer is scraped off.

A density sensor 18 is provided near the intermediate transfer belt 2. Density sensor 18 irradiates the surface of intermediate transfer belt 2 with LED light, and detects light reflected from the surface of intermediate transfer belt 2. The detection signal is output to CPU 120. Based on the detection signal, CPU 120 calculates toner density of toner image on intermediate transfer belt 2.

Figure 13A:
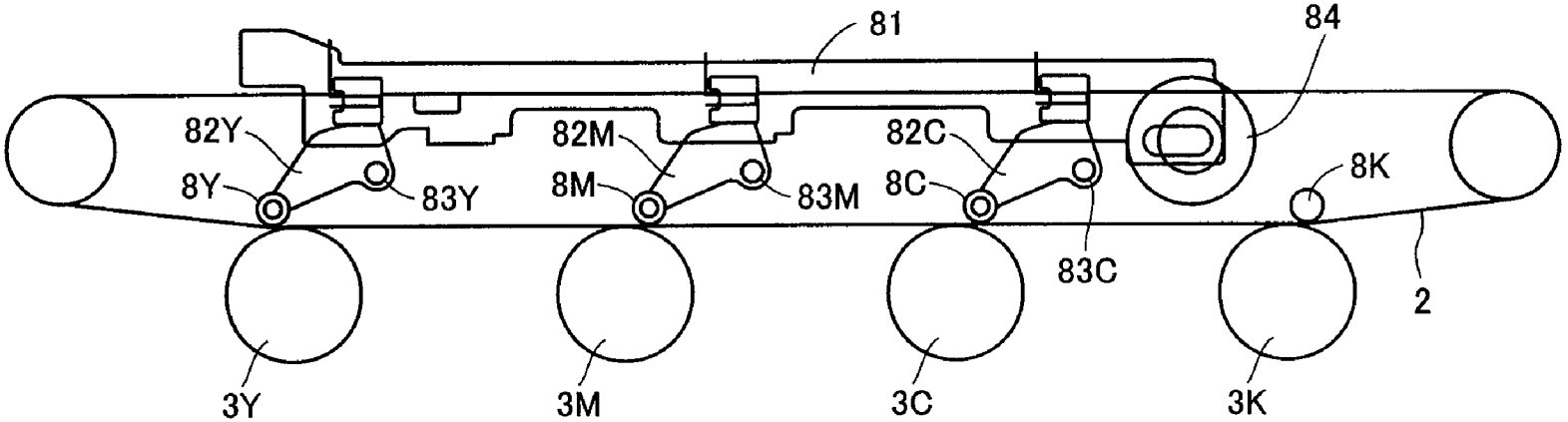
FIGS. 13A to 14 show structures of the transfer roller contact/separation mechanism included in the printer shown in FIG. 12.
Figure 13B:
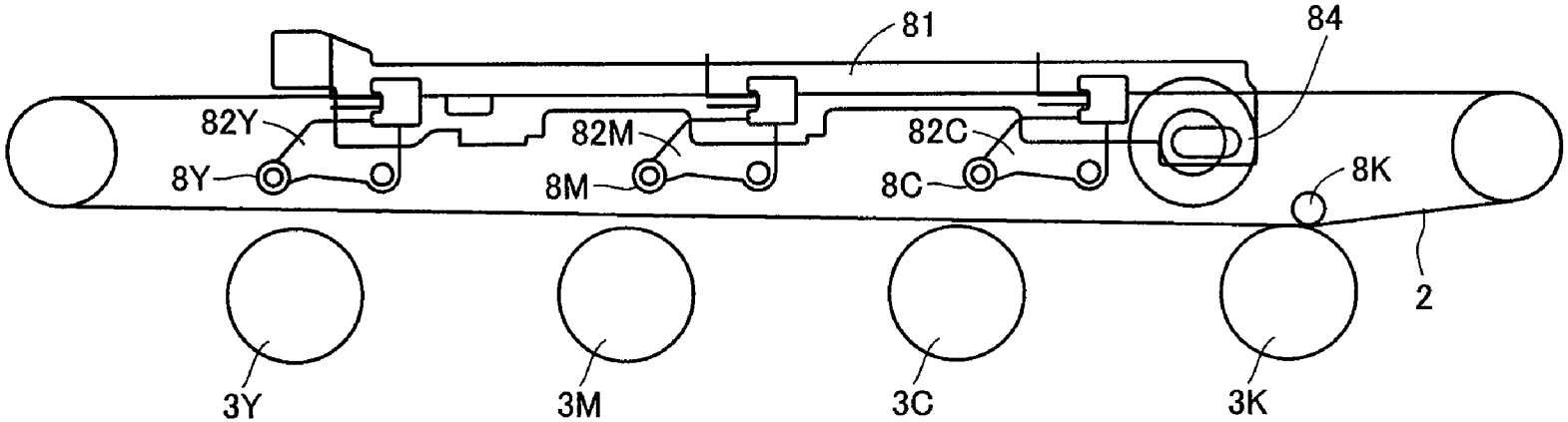
Figure 14:
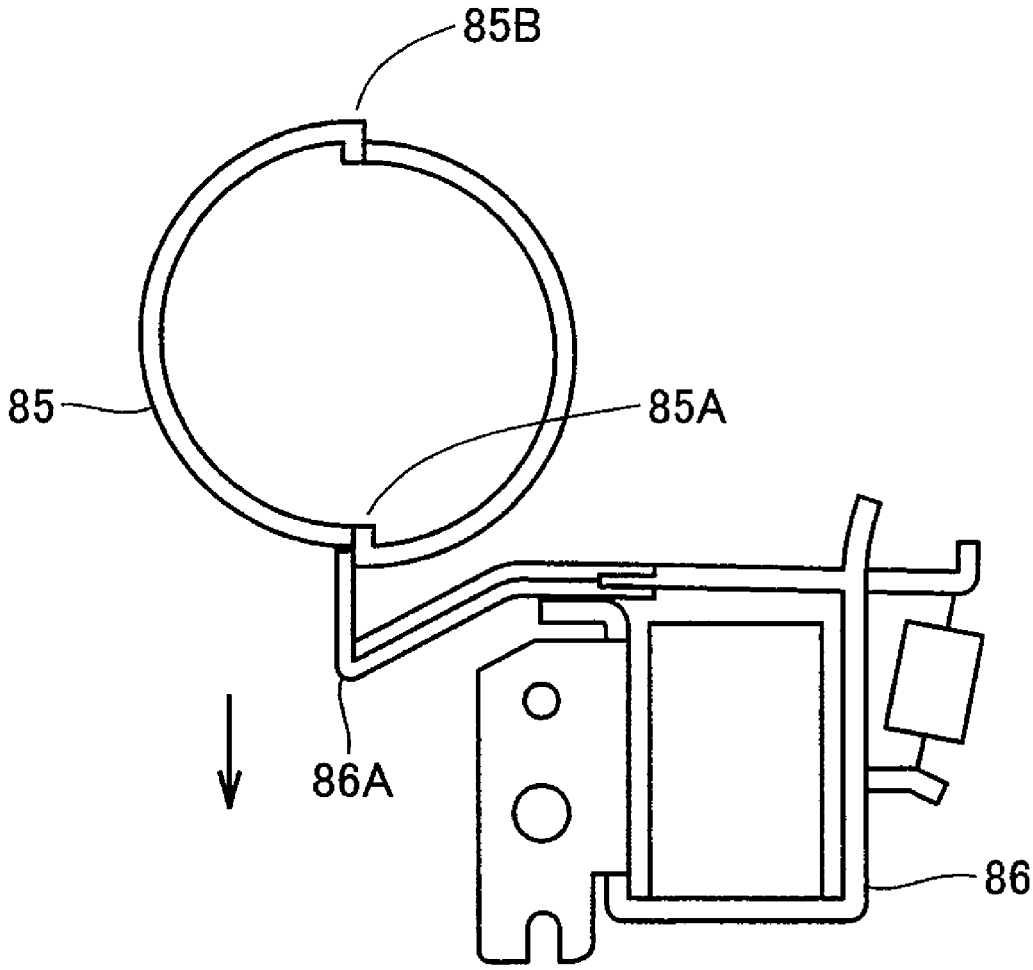

Referring to FIGS. 13A and 13B, the transfer roller contact/separation mechanism includes a lever 81 that is arranged approximately parallel to intermediate transfer belt 2. Lever 81 is connected to a cum 84, and by the rotation of cum 84, moves reciprocally. By the rotation of cum 84, lever 81 moves reciprocally, approximately in parallel with intermediate transfer belt 2 and assumes the first position shown in FIG. 13A and a second position shown in FIG. 13B with respect to intermediate transfer belt 2. Joint portions 82Y, 82M and 82C (generally represented as joint portion 82) provided on lever 81 are joined to primary transfer rollers 8Y, 8M and 8C, respectively. Joint portions 82 are joined rotatable with respect to lever 81, about shaft portions 83Y, 83M and 83C (generally represented as shaft portion 83), respectively. Referring to FIG. 13A, rotation of joint portion 82 about shaft portion 83 is unlocked when lever 81 is at the first position. Therefore, when lever 81 is at the first position, joint portion 82 rotates downward about shaft portion 83 until color primary transfer roller 8 interferes with intermediate transfer belt 2. Consequently, color primary transfer roller 8 joined to joint portion 82 comes to be in contact with intermediate transfer belt 2. Referring to FIG. 13B, when lever 81 is at the second position, rotation of joint portion 82 about shaft portion 83 is locked at a position where color primary transfer roller 8 does not interfere with intermediate transfer belt 2. Therefore, when lever 81 is at the second position, joint portion 82 rotates about shaft portion 83 to a position where color primary transfer roller 8 does not interfere with intermediate transfer belt 2, and rotation is stopped at that position. Thus, primary transfer roller 8 joined to joint portion 82 is separated from intermediate transfer belt 2.

Cum 84 is connected to a clutch 85 (FIG. 14) coupled to a driving motor, not shown, driven in accordance with a control signal from CPU 120, and converts rotation of clutch 85 to radial movement. Clutch 85 is rotated by the driving motor driven in accordance with the control signal from CPU 120. A contact/separation solenoid 86 (FIG. 14) regulates rotation of clutch 85, in accordance with a control signal from CPU 120. Specifically, referring to FIG. 14, clutch 85 has a contact claw 85A and a separation claw 85B provided outward on diametrically opposite positions of clutch 85, as a switching mechanism. Contact/separation solenoid 86 has a stopper 86A provided at a position that can interfere with contact claw 85A or separation claw 85B, and operates stopper 86A in accordance with a control signal from CPU 120. In accordance with a control signal from contact/separation solenoid 86, stopper 86A temporarily moves in a direction indicated by an arrow in FIG. 14, and thereafter returns to the original position. As shown in FIG. 14, when stopper 86A is at a position interfering with contact claw 85A, clutch 85 stops rotation, as contact claw 85 abuts stopper 86A. As the stopper 86A operates in the manner as described above in accordance with the control signal from contact/separation solenoid 86, interference of contact claw 85A with stopper 86A is released, and clutch 85 half-turns until separation claw 85B reaches a position interfering with stopper 86A. Thereafter, stopper 86A that returned to the original position interferes with separation claw 85B, and clutch 85 stops rotation as separation claw 85B abuts stopper 86A. Half-turn of clutch 85 corresponds to half-turn of cum 84. Therefore, as clutch 85 half-turns, cum 84 half-turns, and accordingly, lever 81 assumes the first position (FIG. 13A) or the second position (FIG. 13B).

As described with reference to FIGS. 13A, 13B and 14, in printer 100B, when transfer roller contact/separation mechanism is operated for a prescribed time period, contact/separation of color primary transfer roller 8 to/from intermediate transfer belt 2 is switched by the switching mechanism. Here, the prescribed time period is assumed, for example, to be 100 ms. The prescribed time period specifically corresponds to a time period for half-turning clutch 85. As the contact state is switched to the separate state or the separate state is switched to the contact state by the operation of transfer roller contact/separation mechanism, the state after switching is determined by the state before switching. Therefore, it is necessary at the start of operation of transfer roller contact/separation mechanism to find whether color primary transfer roller 8 is in the contact state or separate state. Therefore, in printer 100B, at a timing of starting/recovering operation, for example, when the power is turned on or a body cover, not shown, is closed, the state of color primary transfer roller 8 is determined. Thereafter, the state of color primary transfer roller 8 is set to the contact state (or separate state) as the default state, and printing operation or the like is executed.

Figure 15:
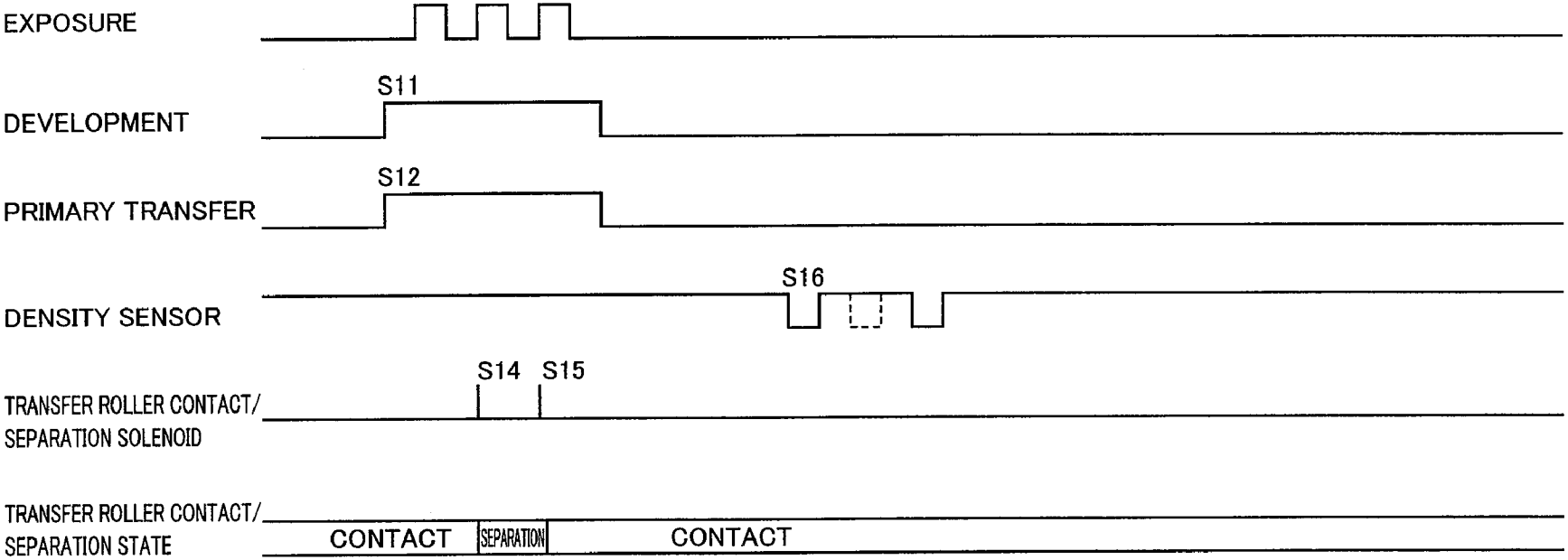
FIGS. 15 to 17 illustrate a determination process performed when the power is turned on or body cover is closed, as a timing of starting/recovering operation, and the state of contact/separation of primary transfer roller for color printing to/from the intermediate transfer belt, in the printer in accordance with the second embodiment of the present invention.
Figure 16:
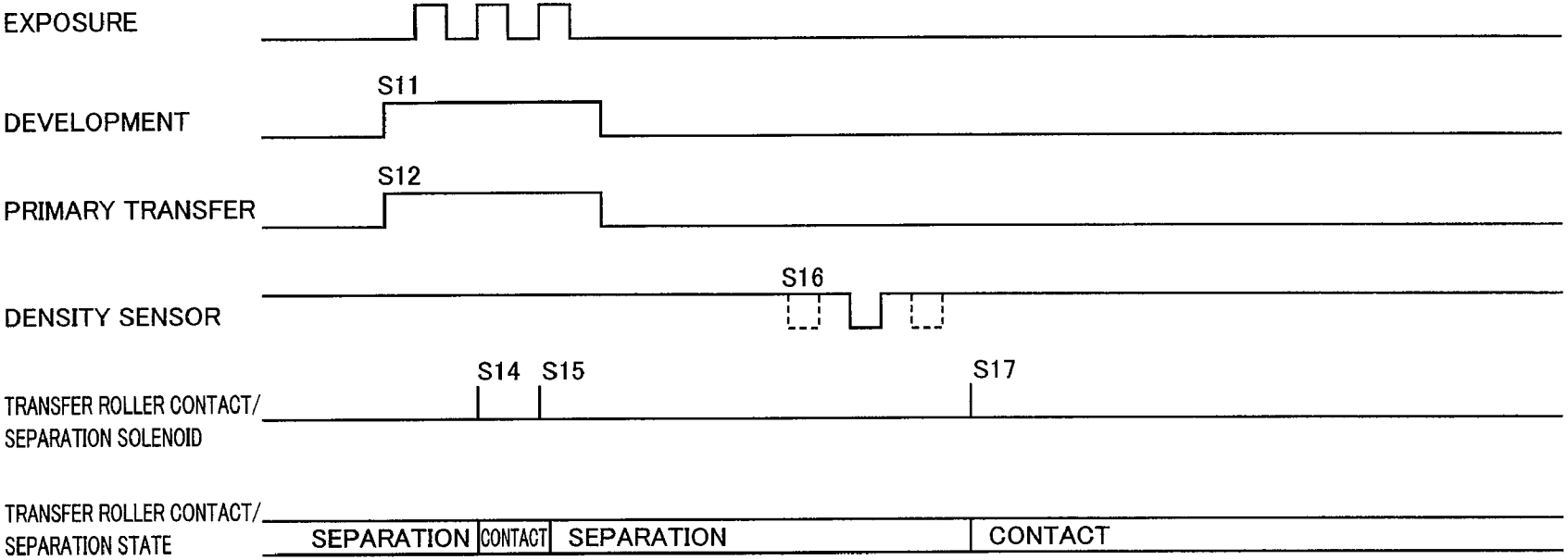

Referring to FIGS. 15 and 16, a determination process performed when the power is turned on or a body cover, not shown, is closed as the timing of starting/recovering an operation of printer 100B and the state of contact/separation of color primary transfer roller 8 to/from intermediate transfer belt 2 will be described. In the process shown in FIGS. 15 and 16, the state of color primary transfer roller 8 is determined and, thereafter, the state of color primary transfer roller 8 is set to the default state in which the roller is in contact with intermediate transfer belt 2, that is, a state allowing color printing. FIGS. 15 and 16 each show operation timings of various mechanisms and the state of contact/separation of color primary transfer roller 8 to/from intermediate transfer belt 2 (in the figure, indicated as "transfer roller contact/separation state"), with time passing from left to right. These mechanisms operate as various portions shown in FIGS. 8 and 12 to 14 are controlled in accordance with control signals output by CPU 120 executing the program stored in ROM 122 or the like. In FIGS. 15 and 16, process steps S11 to S16 are the same, and dependent on the determination at step S16, the flow branches to the process of FIG. 15 or FIG. 16.

Referring to FIGS. 15 and 16, when power-on is detected, or when closing of a body cover, not shown, from the open state is detected, CPU 120 outputs a control signal to developing unit 4, mechanism controlling rotation of driving motor and exposure unit 9 corresponding to one color, among development units 4Y, 4M and 4C, the mechanism controlling rotation of driving motor and exposure units 9Y, 9M and 9C, for forming a toner patch on a surface of photoreceptor 3 and primary-transferring the patch to intermediate transfer belt 2 (steps S11 to S13). Preferably, CPU 120 outputs the control signal to the components corresponding to the cartridge having the largest amount of residual toner, among cartridges 15Y, 15M and 15C.

At steps S11, S12 and S13, CPU 120 outputs a plurality of times the control signal for exposure, to each exposure unit 9. Consequently, a plurality of toner patches are formed on the surface of photoreceptor 3, aligned in the rotating direction of photoreceptor 3. Preferably, the control signal for exposure is output three times, as shown in FIGS. 15 and 16. Thus, three toner patches are formed on the surface of photoreceptor 3, and three patches are developed aligned in the rotating direction of photoreceptor 3. In the present embodiment, it is assumed that three toner patches are developed on photoreceptor 3, and from the upstream side to the downstream side of rotation of photoreceptor 3, the toner patches will be referred to as the first, second and third toner patches.

In the present embodiment, a toner patch on photoreceptor 3 is assumed to have the length (width) of 10 mm in the direction of rotation of photoreceptor 3. The distance between the first and second toner patches and the distance between the second and third toner patches are determined in consideration of time necessary for the transfer roller contact/separation mechanism to operate color primary transfer roller 8 (operation time), a margin time provided in case operation of color primary transfer roller 8 should be delayed, and rotation rate of intermediate transfer belt 2. In the present embodiment, the margin time is set to be 300 ms. These are set in advance, and stored in a prescribed storage device such as storage unit 123. These values may be input or may be changed by a specific user, such as an administrator, through a specific operation.

The operation time mentioned above corresponds to the longer one of the operation time (separation) for separating color primary transfer roller 8 from the contact state with intermediate transfer belt 2 and the operation time (contact) for bringing the roller from the separated state into contact. Specifically, it corresponds to the time from when the operation of color primary transfer roller 8 by the transfer roller contact/separation mechanism starts until the operation is completed. In the present embodiment, the time necessary for separation is assumed to be 550 ms and the time necessary for contact is assumed to be 520 ms. Therefore, in the present embodiment, the operation time mentioned above is set to 550 ms.

CPU 120 stores in advance the length from the exposure position of photoreceptor 3 to the primary transfer portion (for example, 60 mm), the above-described width of toner patch (10 mm), rotation rate of photoreceptor 3 and the like. Therefore, by providing a timer and by counting time lapse from a prescribed timing, it is possible for CPU 120 to detect, to which position in the rotational direction, the position of photoreceptor 3 on which each toner patch is formed by the rotation of photoreceptor 3 corresponds.

CPU 120 counts the lapse of time from when the control signal is output to exposure unit 9 at step S13 until photoreceptor 3 rotates from the exposure position to the primary transfer portion and the rear end of first toner patch passes through the primary transfer portion. When the time described above has passed from the first exposure, the first toner patch exposed on photoreceptor 3 is primary-transferred to intermediate transfer belt 2 and passes through the primary transfer portion.

CPU 120 counts the lapse of time from when the control signal is output to exposure unit 9 at step S13, and when the lapse of that time is detected, that is, when passage of the first toner patch through the primary transfer portion is detected, it outputs at that timing, a control signal to transfer roller contact/separation mechanism for operating color primary transfer roller 8 (step S14). CPU 120 further continues counting and when passage of the second toner patch through the primary transfer unit is detected, it outputs at that timing, a control signal to the transfer roller contact/separation mechanism for operating color primary transfer roller 8 (step S15).

Next, CPU 120 outputs, at a timing when the first toner patch reaches density sensor 18, a control signal to density sensor 18 for irradiating the surface of intermediate transfer belt 2 with LED light.

As a detection signal, density sensor 18 inputs a voltage signal corresponding to the intensity of light reflected from the surface of intermediate transfer belt 2, as an analog value, to CPU 120. By way of example, if the toner patch on intermediate transfer belt 2 has high density, a voltage signal close to 0V is input, and if it has low density, a voltage signal close to 5V is input. CPU 120 stores a threshold value in advance, and compares the voltage value obtained from the voltage signal input by density sensor 18 with the threshold value, to determine whether there is a toner patch on intermediate transfer belt 2 or not (step S16). Specifically, CPU 120 stores, for example, 2.5V as the threshold value. CPU 120 calculates the voltage value as an average value of voltage signals input from density sensor 18 detecting, in the 10 ms period, the light reflected from the toner patch having the width of 10 mm. If the calculated voltage value is not higher than the threshold value of 2.5V, CPU 120 determines that there is a toner patch on intermediate transfer belt 2, and otherwise, determines that there is no toner patch.

At step S16, if determination of no toner patch is made the same number of times as the number of exposure by exposure unit 9 at step S13, that is, if it is determined that none of the first to third patches exist on intermediate transfer belt 2, it is considered that no toner remains or the remaining amount of toner is smaller than a prescribed amount in the cartridge 15 used for exposure in accordance with the control signal at step S13. In that case, CPU 120 returns the process to step S11, and outputs a control signal to the components described above of the next cartridge 15, and repeats process steps S11 to S16. At this time, preferably, CPU 120 outputs the control signal to the components of a cartridge having the amount of remaining toner second largest to the cartridge selected last time, among cartridges 15Y, 15M and 15C, as the next cartridge 15.

When the color primary transfer roller 8 is in the initial state, that is, in contact with intermediate transfer belt 2, the color primary transfer roller 8 is kept in contact with intermediate transfer belt 2 until the rear end of first toner patch on photoreceptor 3 passes through the primary transfer portion. When the color primary transfer roller 8 operates in accordance with the control signal of step S14 described above, the color primary transfer roller 8 is separated from the intermediate transfer belt at a timing after the first toner patch passes through the primary transfer unit and before the front end of the second toner patch reaches the primary transfer portion. Thereafter, when the color primary transfer roller 8 operates in accordance with the control signal of step S15 described above, color primary transfer roller 8 is brought into contact with intermediate transfer belt 2 at a timing after the rear end of the second toner patch passes through the primary transfer portion and before the front end of the third toner patch reaches the primary transfer portion. Therefore, the first and third toner patches are primary-transferred to the intermediate transfer belt 2, while the second toner patch is not primary-transferred to the intermediate transfer belt 2.

CPU 120 continues counting described above and, assume that, as shown in FIG. 15, at step S16, it determines that the toner patches exist at the positions of the first toner patch and the third toner patch on intermediated transfer belt 2 and a toner patch does not exist at the position of the second toner patch, based on the position of intermediate transfer belt 2 detected from the count value and on presence/absence of toner patch determined from the voltage signals from density sensor 18. In FIG. 15, the timing of determination that toner patch is absent is represented by dotted lines. Here, it is determined that color primary transfer roller 8 has operated such that the first and third toner patches have been primary-transferred to the intermediate transfer belt 2 and the second toner patch is not primary-transferred to intermediate transfer belt 2. Therefore, when the presence/absence of toner patches is determined as shown in FIG. 15, CPU 120 determines at step S16 that the transfer roller contact/separation mechanism is operating normally in accordance with control signals applied at steps S14 and S15 and that in the initial state, the color primary transfer roller 8 is in contact with intermediate transfer belt 2.

On the other hand, assume that at step S16, CPU 120 determines that toner patches do not exist at positions of the first and third toner patches on intermediate transfer belt 2 and that a toner patch exists at the position of second toner patch, as shown in FIG. 16. In FIG. 16 also, the timing of determination that toner patch is absent is represented by dotted lines. Here, it is determined that color primary transfer roller 8 has operated such that the second toner patch has been primary-transferred to the intermediate transfer belt 2 and the first and third toner patches are not primary-transferred to intermediate transfer belt 2. Therefore, when the presence/absence of toner patches is determined as shown in FIG. 16, CPU 120 determines at step S16 that the transfer roller contact/separation mechanism is operating normally in accordance with control signals applied at steps S14 and S15 and that in the initial state, the color primary transfer roller 8 is separated from intermediate transfer belt 2.

If it is determined at step S16 that in the initial state, color primary transfer roller 8 is in contact with intermediate transfer belt 2 as shown in FIG. 15, CPU 120 proceeds to a succeeding process, without causing any operation of color primary transfer roller 8. If it is determined at step S16 that in the initial state, color primary transfer roller 8 is separated from intermediate transfer belt 2 as shown in FIG. 16, CPU 120 outputs a control signal to the transfer roller contact/separation mechanism for operating color primary transfer roller 8 (step S17). Consequently, color primary transfer roller 8 comes to be in the default state, in which it is in contact with intermediate transfer belt 2.

As described above, if color primary transfer roller 8 is separate from intermediate transfer belt 2 in the initial state, it becomes necessary after the determination of step S16 to perform control for rotating color primary transfer roller 8 at step S17. Therefore, as the initial state, the state in which color primary transfer roller 8 is in contact with intermediate transfer belt 2 is preferred than the state in which it is separated from the belt, as the required amount of processing for determination and process time can be reduced.

Figure 17:
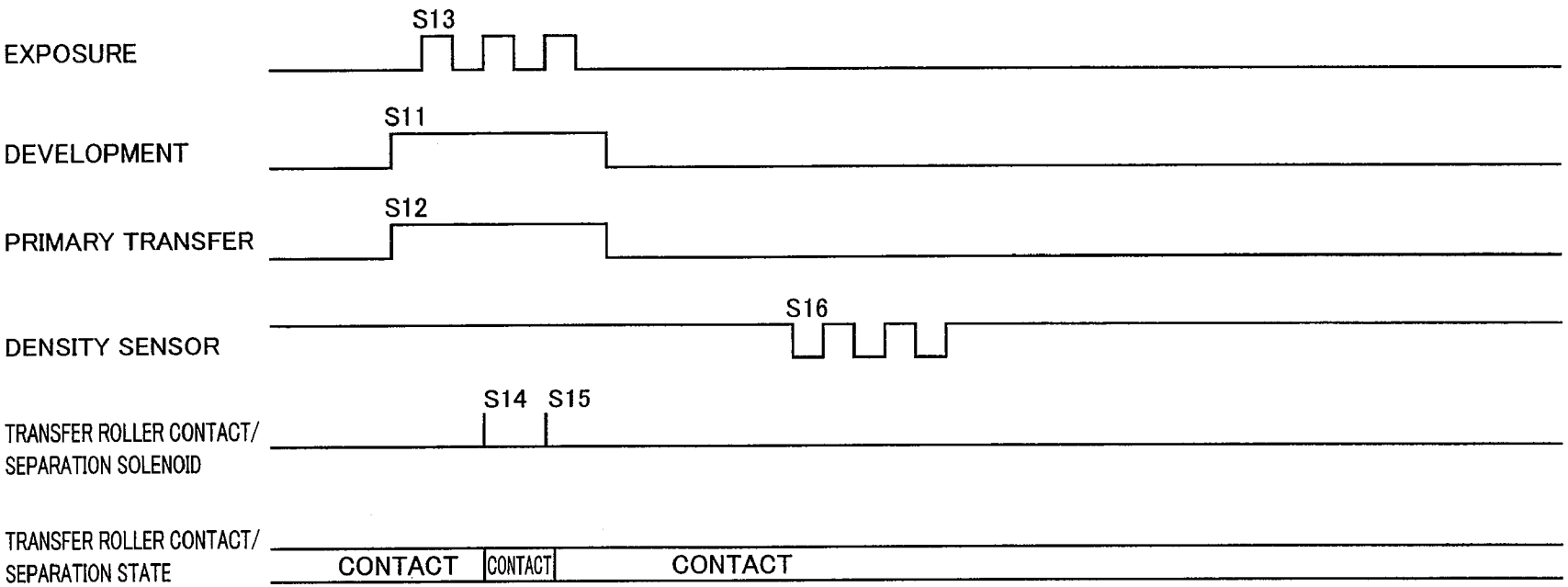

The process of CPU 120 when determination of neither FIG. 15 nor FIG. 16 is made at step S16 will be described with reference to FIG. 17.

Assume that at step S16, determination is other than alternate existence of toner patches at the first to third toner patches as shown in FIG. 15 or FIG. 16. For instance, if it is determined at step S16 that toner patches exist on all of the first to third positions, as shown in FIG. 17, CPU 120 determines that the transfer roller contact/separation mechanism is malfunctioning. If such a determination is made, it is considered that color primary transfer roller 8 is in contact with the intermediate transfer belt 2 at the initial state, color primary transfer roller 8 has not operated and is kept in contact with intermediate transfer belt 2. As another example, if it is determined at step S16 that the first and second toner patches exist while a toner patch does not exist at the position of the third toner patch, or that a toner patch does not exist at the position of the first toner patch and the second and third toner patches exist, CPU also determines that the transfer roller contact/separation mechanism is malfunctioning.

If it is determined by CPU 120 at step S16 that the cleaner contact/separation mechanism is malfunctioning, preferably, CPU 120 performs a process for giving an alarm to that effect, for example, giving an indication on a display panel 111*a*.

In the specific example above, three toner patches are formed on the surface of photoreceptor 3 as the plurality of toner patches. The number of toner patches, however, is not limited to three, and it may be any number not smaller than two.

By way of example, assume that the number of toner patches is two. Specifically, assume that the first and second toner patches as the two toner patches are formed on photoreceptor 3. If it is determined at step S16 that a toner patch exists at the position of first toner patch and a toner patch does not exist at the position of second toner patch, CPU 120 determines that color primary transfer roller 8 has been in contact with intermediate transfer belt 2 at the initial state, and that color primary transfer roller 8 operated at step S14 and has been separated from intermediate transfer belt 2. In other words, it is determined that the transfer roller contact/separation mechanism is operating normally. Further, assume that at step S16, no toner patch exists at the position of first toner patch and the second toner patch exists. In that case, CPU 120 determines that color primary transfer roller 8 has been separated from intermediate transfer belt 2 at the initial state, and that color primary transfer roller 8 operated at step S14 and has been brought into contact with intermediate transfer belt 2. In other words, it is determined that the transfer roller contact/separation mechanism is operating normally. Further, assume that at step S16, it is determined that both first and second toner patches exist, or that toner patch does not exist at either of these positions. In that case, CPU 120 determines that transfer roller contact/separation mechanism is malfunctioning.

If the number of toner patches that are primary-transferred is two, whether the transfer roller contact/separation mechanism operates normally/abnormally is determined only on the operation for separating color primary transfer roller 8 from the intermediate transfer belt 2 from the contact state, or on the operation for bringing into contact the color primary transfer roller 8 to intermediate transfer belt 2 from the separate state. Therefore, it is more preferred to primarily transfer three or more toner patches as shown in the example above, since whether the transfer roller contact/separation mechanism operates normally/abnormally can be determined on both operations. When three or more toner patches are transferred, it is preferred to repeat control of steps S14 and S15 so that image forming positions of respective toner patches pass through the primary transfer portion with color primary transfer roller 8 being in the contact state and separate state alternately. In this manner, presence/absence of a toner patch on intermediate transfer belt 2 is detected at step S16 and CPU 120 can determine whether or not the transfer roller contact/separation mechanism operates normally.

The timing of starting/recovering operation may include a start of operation after an abnormal end of processing of printer 100B. "Abnormal end" may include paper jam, or power-off of printer 100B during printing. It is preferred that, when an operation for normal ending is performed and the printer operation ends accordingly, CPU 120 so stores in an area of which data is not erased even after power-off. By such an arrangement, it is possible to determine whether operation ended normally or abnormally last time, by making reference to the storage area at the timing of starting/recovering operation. After an abnormal end, toner may possibly be left on the surface of intermediate transfer belt 2. Therefore, if power is turned on or a body cover, not shown, is closed and the operation of printer 100B is resumed after an abnormal end, it is preferred that CPU 120 performs cleaning of the surface of intermediate transfer belt 2, before making the determination at the timing of starting/recovering operation. In that case, it is preferred that CPU 120 performs the determination process described above at a timing when intermediate transfer belt 2 has passed through belt cleaner 5 and the cleaned surface reaches the primary transfer portion.

Because of the process described above performed in printer 100B, it becomes possible for CPU 120 to determine whether the transfer roller contact/separation mechanism operates normally/abnormally based on the detection signal from density sensor 18, without using a sensor for detecting contact/separation of color primary transfer roller 8.

Modification of Second Embodiment

In the example described above, the determination process is performed at the timing of starting/recovering operation, for example, when the power is turned on, or when a body cover, not shown, is closed. The process, however, may be performed at other timings. For example, the process may be performed when a print instruction is input through an input key 111*b*, when standby period of printing process exceeds a prescribed time period, or when the printing process ends.

In printer 100B, whether the transfer roller contact/separation mechanism operates normally/abnormally is determined by CPU 120 based on the detection signal from density sensor 18, through the determination process described above. If the printer 100B has a cleaner contact/separation mechanism and cleaner blade 51 is brought into contact with/separated from intermediate transfer belt 2 by the operation of cleaner belt 5, the determination process for determining whether the cleaner contact/separation mechanism operates normally/abnormally described in the first embodiment may be performed in printer 100B.

Further, a program for causing printer 100A to execute the process described above, or a program for causing printer 100B to execute the process described above may be provided. A program causing both of these processes may also be provided. Such a program may be stored in a computer readable recording medium such as a flexible disk, CD-ROM (Compact Disk-Read Only Memory), ROM, RAM or a memory card, and provided as a program product. Alternatively, the program may be provided recorded in a recording medium such as a hard disk, built in a computer. Further, the program may be provided by down-loading from a network.

The program in accordance with the present invention may be realized by calling necessary modules in a prescribed sequence at prescribed timings to execute processes, from program modules provided as part of the operating system (OS) of a computer. In such a case, the program itself does not include the modules mentioned above, and the processes are executed in cooperation with the OS. Such a program not including the modules is also encompassed by the present invention.

Further, the program in accordance with the present invention may be provided incorporated as a part of another program. In that case also, the program itself does not include the modules included in said another program, and the processes are executed in cooperation with said another program. Such a program incorporated in another program is also encompassed by the present invention.

The program product provided by the invention is executed installed in a program storage such as a hard disk. The program product includes the program itself and a storage medium storing the program.

Although the present invention has been described and illustrated in detail, it is clearly understood that the same is by way of illustration and example only and is not to be taken by way of limitation, the scope of the present invention being interpreted by the terms of the appended claims.

What is claimed is:

1. An image forming apparatus, comprising:

an image carrier carrying a toner image on its surface;

a transfer unit for transferring said toner image on said image carrier to an intermediate transfer body rotating in a prescribed direction;

a cleaning unit that can be brought into contact with and separated from said intermediate transfer body, for cleaning a surface of said intermediate transfer body in a contact state;

a detecting unit detecting density of the toner image transferred to said intermediate transfer body;

a contact/separation mechanism performing an operation of setting said cleaning unit to a state in contact with or a state separated from said intermediate transfer body; and a control unit configured to cause said transfer unit to transfer a plurality of toner images spaced by a prescribed distance in said direction of rotation on said intermediate transfer body, cause, when said plurality of toner images pass through said cleaning unit, said contact/separation mechanism to perform said operation to set said cleaning unit to the state in contact with or the state separated from said intermediate transfer body, alternately said toner image by toner image, detect presence/absence of each toner image on said intermediate transfer body using said detecting unit, after said operation of said contact/separation mechanism, and determine, based on the result of detection, state of contact/separation of said cleaning unit to/from said intermediate transfer body.

2. The image forming apparatus according to claim 1, wherein said control unit causes said transfer unit to transfer first, second and third toner images as three toner images in this order on said intermediate transfer body, spaced by a prescribed distance in said direction of rotation, determines that said contact/separation mechanism is performing said operation if the result of said detection is a first result in which said first and third toner images are detected from said intermediate transfer body and said second toner image is not detected from said intermediate transfer body, or a second result in which said second toner image is detected from said intermediate transfer body and said first and third toner images are not detected from said intermediate transfer body, and determines that said contact/separation mechanism is not performing said operation if the result of said detection is none of said first result, said second result and detection of none of said first to third toner images.

3. The image forming apparatus according to claim 2, wherein said control unit determines, if the result of said detection is said first result, initial state of said cleaning unit with respect to said intermediate transfer body before said contact/separation mechanism starts its operation to be the separate state, and determines, if the result of said detection is said second result, initial state of said cleaning unit with respect to said intermediate transfer body before said contact/separation mechanism starts its operation to be the contact state.

4. The image forming apparatus according to claim 1, wherein said prescribed distance is determined based on time necessary for said operation of said contact/separation mechanism and on speed of movement of said intermediate transfer body.

5. The image forming apparatus according to claim 1, further comprising a plurality of developers supplying toner to an electrostatic latent image formed on said image carrier for forming a toner image; wherein said control unit causes that one of said plurality of developers which has largest amount of residual toner to form said plurality of toner images, and if the result of said detection is detection of none of said plurality of toner images, causes a developer, which has amount of residual toner second largest to said developer that formed the plurality of toner images, to form toner images and to transfer the images again.

6. The image forming apparatus according to claim 1, wherein said control unit determines, based on the result of said detection, whether the initial state of said cleaning unit with respect to said intermediate transfer body before said contact/separation mechanism starts its operation is the separate state or the contact state, and after said operation, causes further operation of said contact/separation mechanism based on said initial state.

7. The image forming apparatus according to claim 6, wherein if it is determined that the initial state of said cleaning unit with respect to said intermediate transfer body is the separate state, said control unit causes said contact/separation mechanism to move said cleaning unit from the separate state to the contact state.

8. The image forming apparatus according to claim 1, wherein said control unit executes the process of determining the state of contact/separation of said cleaning unit to/from said intermediate transfer body at least at a timing when power is turned on, when an operation is resumed from an operation suspended state, when image forming process starts, when image forming process ends or when interval between image forming processes reached a prescribed time period.

9. The image forming apparatus according to claim 1, further comprising an alarm unit, when said control unit determines that said contact/separation mechanism is not performing said operation, for giving an alarm to that effect.

10. The image forming apparatus according to claim 1, wherein said control unit includes a storage unit storing a state of said image forming apparatus at the end of an operation, causes, at the start of an operation, dependent on said state at the end of immediately preceding operation, said cleaning unit to pass over entire surface of said intermediate transfer body while not causing said contact/separation mechanism to perform said operation, after said passage, causes said contact/separation mechanism to perform said operation and causes said cleaning unit to pass over the entire surface of said intermediate transfer body, and after said passage, determines the state of contact/separation of said cleaning unit to/from said intermediate transfer body.

11. An image forming apparatus, comprising:

a plurality of image carriers rotating in a prescribed direction;

a plurality of developers supplying toner to an electrostatic latent image formed on each of said plurality of image carriers for forming toner images;

a plurality of transfer units for transferring said toner images formed on said plurality of image carriers to an intermediate transfer body rotating in a prescribed direction;

a detecting unit detecting density of the toner image transferred on said intermediate transfer body;

a contact/separation mechanism performing an operation of setting at least one of said plurality of transfer units to a state in contact with or a state separate from said intermediate transfer body; and a control unit; wherein said control unit causes at least one of said plurality of developing units to form a plurality of toner images on at least one of said plurality of image carriers, spaced by a prescribed distance in a direction of rotation of said image carrier, when said plurality of toner images pass through said transfer unit, causes said contact/separation mechanism to perform said operation for setting said transfer unit to the state in contact with or to the state separated from said intermediate transfer body alternately toner image by toner image, after the operation of said contact/separation mechanism, detects presence/absence of each toner image on said intermediate transfer body, using said detecting unit, and determines, based on a result of said detection, state of contact/separation of said transfer unit to/from said intermediate transfer body.

12. The image forming apparatus according to claim 11, wherein said control unit causes said at least one developer to form first, second and third toner images as three toner images in this order on said at least one image carrier, determines that said contact/separation mechanism is performing said operation if the result of said detection is a first result in which said first and third toner images are detected from said intermediate transfer body and said second toner image is not detected from said intermediate transfer body, or a second result in which said second toner image is detected from said intermediate transfer body and said first and third toner images are not detected from said intermediate transfer body, and determines that said contact/separation mechanism is not performing said operation if the result of said detection is none of said first result, said second result and detection of none of said first to third toner images.

13. The image forming apparatus according to claim 12, wherein said control unit determines, if the result of said detection is said first result, initial state of said transfer unit with respect to said intermediate transfer body before said contact/separation mechanism starts its operation to be the separate state, and determines, if the result of said detection is said second result, initial state of said transfer unit with respect to said intermediate transfer body before said contact/separation mechanism starts its operation to be the contact state.

14. The image forming apparatus according to claim 11, wherein said prescribed distance is determined based on time necessary for said operation of said contact/separation mechanism, on speed of movement of said intermediate transfer body, and on development rate of said developer.

15. The image forming apparatus according to claim 11, wherein said control unit causes that one of said plurality of developers which has largest amount of residual toner to form said plurality of toner images, and if the result of said detection is detection of none of said plurality of toner images, causes a developer, which has amount of residual toner second largest to said developer that formed the plurality of toner images, to form toner images and to transfer the images again.

16. The image forming apparatus according to claim 11, wherein said control unit determines, based on the result of said detection, whether the initial state of said transfer unit with respect to said intermediate transfer body before said contact/separation mechanism starts its operation is the separate state or the contact state, and after said operation, causes further operation of said contact/separation mechanism based on said initial state.

17. The image forming apparatus according to claim 16, wherein if it is determined that the initial state of said transfer unit with respect to said intermediate transfer body is the separate state, said control unit causes said contact/separation mechanism to move said transfer unit from the separate state to the contact state.

18. The image forming apparatus according to claim 11, wherein said control unit executes the process of determining the state of contact/separation of said transfer unit to/from said intermediate transfer body at least at a timing when power is turned on, when an operation is resumed from an operation suspended state, when image forming process starts, when image forming process ends or when interval between image forming processes reached a prescribed time period.

19. The image forming apparatus according to claim 11, further comprising an alarm unit, when said control unit determines that said contact/separation mechanism is not performing said operation, for giving an alarm to that effect.

20. The image forming apparatus according to claim 11, wherein said control unit includes a storage unit storing a state of said image forming apparatus at the end of an operation, causes, at the start of an operation, a cleaning unit to clean entire surface of said intermediate transfer body, dependent on said state at the end of immediately preceding operation, and at a timing when said cleaned intermediate transfer body reaches said developer, determines the state of contact/separation of said transfer unit to/from said intermediate transfer body.

21. In an image forming apparatus including an image carrier carrying a toner image on its surface, a transfer unit for transferring said toner image on said image carrier to an intermediate transfer body rotating in a prescribed direction, a cleaning unit that can be brought into contact with and separated from said intermediate transfer body, for cleaning a surface of said intermediate transfer body in a contact state, a detecting unit detecting density of the toner image transferred to said intermediate transfer body, and a contact/separation mechanism performing an operation of setting said cleaning unit to a state in contact with or a state separated from said intermediate transfer body, a control unit configured to confirm an operation of said contact/separation mechanism by:

causing said transfer unit to transfer a plurality of toner images spaced by a prescribed distance in said direction of rotation to said intermediate transfer body;

causing, when said plurality of toner images pass through said cleaning unit, said contact/separation mechanism to set said cleaning unit to the state in contact with or the state separated from said intermediate transfer body, alternating between the state in contact with and the state separated from between each toner image; and detecting presence/absence of each toner image on said intermediate transfer body using said detecting unit, after said setting of said cleaning unit to the state in contact with or the state separated from said intermediate transfer body, and determining, based on the result of detection, state of contact/separation of said cleaning unit to/from said intermediate transfer body.

22. In an image forming apparatus including a plurality of image carriers rotating in a prescribed direction, a plurality of developers supplying toner to an electrostatic latent image formed on each of said plurality of image carriers for forming toner images, a plurality of transfer units for transferring said toner images formed on said plurality of image carriers to an intermediate transfer body rotating in a prescribed direction, a detecting unit detecting density of the toner image transferred on said intermediate transfer body, and a contact/separation mechanism performing an operation of setting at least one of said plurality of transfer units to a state in contact with or a state separate from said intermediate transfer body, a control unit configured to confirm an operation of said contact/separation mechanism by:

forming a plurality of toner images on at least one of said plurality of image carriers, spaced by a prescribed distance in a direction of rotation of said image carrier;

causing, when said plurality of toner images pass through said transfer units, said contact/separation mechanism to set said transfer units to the state in contact with or the state separated from said intermediate transfer body, alternating between the state in contact with and the state separated from between each toner image; and detecting presence/absence of each toner image on said intermediate transfer body using said detecting unit, after said setting of said transfer units to the state in contact with or the state separated from said intermediate transfer body, and determining, based on the results of detection, state of contact/separation of said transfer units to/from said intermediate transfer body.

* * * * *